US008113513B2

(12) United States Patent
Funada

(10) Patent No.: US 8,113,513 B2
(45) **Date of Patent: *Feb. 14, 2012**

(54) SHEET PROCESSING APPARATUS WITH CROSS-DIRECTIONALLY MOVING DEVICE

(75) Inventor: Naoyasu Funada, Moriya (JP)

(73) Assignee: Canon Finetech Inc., Misato-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/645,604

(22) Filed: Dec. 23, 2009

(65) Prior Publication Data

US 2010/0096800 A1 Apr. 22, 2010

Related U.S. Application Data

(62) Division of application No. 11/237,776, filed on Sep. 29, 2005, now Pat. No. 7,665,730.

(30) Foreign Application Priority Data

Oct. 1, 2004 (JP) ..... 2004-290811
Oct. 1, 2004 (JP) ..... 2004-290812

(51) Int. Cl.
*B65H 9/16* (2006.01)

(52) U.S. Cl. ..... 271/250; 271/314; 271/220; 271/252; 270/58.12

(58) Field of Classification Search ..... 270/58.12, 270/58.17, 58.27, 58.11, 58.16; 271/184, 271/81, 84, 220, 221, 228, 249, 250, 252–255
See application file for complete search history.

(56) References Cited

U.S. PATENT DOCUMENTS 5,618,035 A * 4/1997 Coombs et al. ..... 271/213
5,791,644 A 8/1998 Regimbal et al.
6,273,418 B1 * 8/2001 Fujikura et al. ..... 271/228
6,382,615 B1 5/2002 Ishiguro et al.
6,427,997 B1 8/2002 Hirota et al.
6,505,831 B2 1/2003 Henn et al.
6,561,503 B1 5/2003 Ogata et al.
6,668,155 B1 12/2003 Hubble et al.
6,783,125 B2 8/2004 Shoji et al.
6,819,906 B1 11/2004 Herrmann et al.
6,910,688 B2 6/2005 Saito et al.
7,192,020 B2 3/2007 Hayashi et al.
7,392,983 B2 7/2008 Kodama et al.
7,453,513 B2 11/2008 Makii
7,566,051 B2 7/2009 Kodama et al.
7,665,730 B2 * 2/2010 Funada ..... 271/250
2003/0219294 A1 11/2003 Yoshimura et al.
2004/0173960 A1 9/2004 Oikawa et al.
2004/0181308 A1 * 9/2004 Hayashi et al. ..... 700/223
2009/0256302 A1 10/2009 Kodama et al.

FOREIGN PATENT DOCUMENTS

JP 8-9088 1/1996
JP 8-67400 3/1996
JP 2003-137472 5/2003
JP 2005-89121 4/2005

* cited by examiner

*Primary Examiner* — Jeremy R Severson

(74) *Attorney, Agent, or Firm* — Fitzpatrick, Cella, Harper & Scinto

(57) ABSTRACT

A sheet processing apparatus including a cross-directionally moving device for moving a sheet in a direction crossing a sheet discharging direction, and a cross-side restricting member for receiving one side edge of the sheet moved in the crossing direction by the cross-directionally moving device, and restricting the movement of the sheet, wherein the cross-directionally moving device moves the next sheet from a position between the other side edge of the sheet received by the cross-side restricting member and the cross-side restricting member to the cross-side restricting member.

4 Claims, 21 Drawing Sheets

| |
|---|
| FIG. 8A |
| FIG. 8B |
| FIG. 8C |

| |
|---|
| FIG. 17A |
| FIG. 17B |
| FIG. 17C |

SHEET PROCESSING APPARATUS WITH CROSS-DIRECTIONALLY MOVING DEVICE

This is a divisional of U.S. patent application Ser. No. 11/237,776, filed Sep. 29, 2005, and allowed Sep. 21, 2009.

This application claims the priority benefits of Japanese Patent Applications Nos. 2004-290811 and 2004-290812 filed Oct. 1, 2004, the entire disclosure of which is hereby incorporated herein by reference in their entirety.

BACKGROUND OF THE INVENTION

1. Field of the Invention

The invention relates to a sheet processing apparatus which moves sheets successively stacked on a tray in a direction crossing a sheet discharging direction to thereby align the side edges of the sheets, and an image forming apparatus provided with the same.

2. Description of the Related Art

There has heretofore been a sheet processing apparatus which moves sheets one by one on a tray in a direction crossing a sheet discharging direction by a cross-directionally moving member to thereby abut one side edge of the sheet against a cross-side restricting member and align the side edge (side edge alignment) (Japanese Patent Application Laid-open No. H8-67400). The side edge refers to that edge of the sheet which is along the sheet discharging direction.

The standby position of the cross-directionally moving member is coincident with the center of the sheet discharged to the tray in the width direction thereof. Therefore, the cross-directionally moving member is adapted to contact with the central portion of the sheet in the width direction thereof to thereby move the sheet in the width direction thereof and abut it against the cross-side restricting member.

Also, the sheet processing apparatus is adapted to be provided, for example, in the apparatus main body of an image forming apparatus for forming an image on a sheet, and effect the side edge alignment of the sheet on which an image has been formed and which has been discharged from the apparatus main body.

Further, the sheet processing apparatus is adapted to abut a sheet against the cross-side restricting member at a substantially constant speed to thereby effect side edge alignment.

However, the cross-directionally moving member of the conventional sheet processing apparatus, when it moves a succeeding sheet on a preceding sheet to thereby abut one side edge of the succeeding sheet against the cross-side restricting member, has sometimes slidden relative to the succeeding sheet because the cross-directionally moving member sides onto the other side edge of the preceding sheet through the succeeding sheet. Particularly, when the side edge portion of the preceding sheet is upwardly curled, the cross-directionally moving member has sometimes slidden on the succeeding sheet.

Therefore, the sheet processing apparatus has sometimes been incapable of reliably align the side edge of the succeeding sheet. Also, when the cross-directionally moving member rides onto the other side edge of the preceding sheet through the succeeding sheet, it has sometimes disturbed the alignment of the preceding sheet.

Further, there has been the problem that a sheet bundle thus subjected to a disturbed side edge aligning process, when subjected to post-processing such as stapling, becomes a poor-looking sheet bundle.

Also, the conventional sheet processing apparatus is adapted to abut a sheet against the cross-side restricting member at a substantially constant movement speed to thereby effect side edge alignment and therefore, the cross-directionally moving member has sometimes wrinkled the side edge portion of the sheet, and the sheet has sometimes been rebounded by the reaction resulting from the abutting. For this reason, in the conventional sheet processing apparatus, it has been difficult for the sheet to be reliably abutted against the cross-side restricting member without the side edge portion thereof being wrinkled and without being rebounded. Particularly, when the side edge of the sheet remains incapable of being aligned and thereafter, post-processing such as binding a sheet bundle is performed, there has arisen the problem that the sheet bundle becomes a poor-looking sheet bundle of which the side edges are not uniform.

Also, an image forming apparatus provided with a sheet processing apparatus poor in its side edge aligning performance cannot smoothly feed sheets into the sheet processing apparatus and therefore, has been incapable of enhancing its image forming efficiency.

SUMMARY OF THE INVENTION

It is an object of the present invention to provide a sheet processing apparatus which can reliably align the side edges of sheets.

It is also an object of the present invention to provide an image forming apparatus provided with a sheet processing apparatus which can reliably align the side edges of sheets in an apparatus main body.

In order to achieve the above object, a sheet processing apparatus according to an embodiment of the present invention is provided with a cross-directionally moving device for moving a sheet in a direction crossing a sheet discharging direction, and a cross-side restricting member for receiving one side edge of the sheet moved in the direction crossing the sheet discharging direction by the cross-directionally moving device, and restricting the movement of the sheet, and the cross-directionally moving device moves the next sheet from a position between the other side edge of the sheet received by the cross-side restricting member and the cross-side restricting member to the cross-side restricting member.

The sheet processing apparatus may be further provided with a sheet stacking portion on which sheets are stacked, and a sheet discharging member for discharging the sheets to the sheet stacking portion, and the sheet discharging member may preferably be capable of discharging the next sheet to a position overlapping the other side edge of the sheet received by the cross-side restricting member.

The aforedescribed position between the other side edge of the sheet and the cross-side restricting member may preferably be variable in accordance with the size of the sheet.

The sheet processing apparatus may be further provided with a curl detector for detecting the curl of the sheet, and may be designed such that when the curl detector detects that the sheet is curled, the cross-directionally moving device starts the movement of the sheet from a position nearer to the cross-side restricting member than the aforementioned position when the sheet is not curled.

In order to achieve the above object, an image forming apparatus according to an embodiment of the present invention is provided with an image forming portion for forming an image on a sheet, and any one of the aforedescribed sheet processing apparatuses, and the sheet processing apparatus aligns one side edge of the sheet on which the image has been formed by the image forming portion.

In order to achieve the above object, an image forming apparatus according to an embodiment of the present invention is provided with an image forming portion for forming an image on a sheet, a sheet stacking portion on which sheets are stacked, a cross-directionally moving device for moving the sheet in a direction crossing a sheet discharging direction, and a cross-side restricting member for receiving one side edge of the sheet moved in the crossing direction by the cross-directionally moving device, and restricting the movement of the sheet, and the cross-directionally moving device moves the sheet from a position between the other side edge of the sheet received by the cross-side restricting member and the cross-side restricting member to the cross-side restricting member.

It is also an object of the present invention to provide a sheet processing apparatus which causes little misalignment during the alignment of the side edge of a sheet.

It is also an object of the present invention to provide an image forming apparatus provided with a sheet processing apparatus excellent in the aligning property of the side edge of a sheet, and enhanced in image forming efficiency.

It is also an object of the present invention to provide a sheet processing apparatus which can decelerate the movement speed of a sheet and align the sheet when it moves the sheet on a tray in a direction crossing a sheet discharging direction to thereby align the side edge of the sheet, and an image forming apparatus provided with the same.

In order to achieve the above object, a sheet processing apparatus according to an embodiment of the present invention is provided with a cross-directionally moving device for moving a sheet in a direction crossing a sheet discharging direction, and a cross-side restricting member for receiving one side edge of the sheet moved in the crossing direction by the cross-directionally moving device, and restricting the movement of the sheet, and the cross-directionally moving device decelerates the movement speed of the sheet and causes the sheet to abut against the cross-side restricting member.

The movement distance of the sheet at a speed before decelerated may preferably be greater than the movement distance of the sheet at the decelerated speed.

The cross-directionally moving device may preferably further move the sheet by a predetermined amount still after it has caused the sheet to abut against the cross-side restricting member.

The cross-directionally moving device may preferably be separable from the sheet after it has caused the sheet to abut against the cross-side restricting member.

In order to achieve the above object, an image forming apparatus according to an embodiment of the present invention is provided with an image forming portion for forming an image on a sheet, and any one of the aforedescribed sheet processing apparatuses, and the sheet processing apparatus aligns that side edge of the sheet which is along a sheet discharging direction.

In order to achieve the above object, an image forming apparatus according to an embodiment of the present invention is provided with an image forming portion for forming an image on a sheet, a cross-directionally moving device for moving the sheet in a direction crossing a sheet discharging direction, and a cross-side restricting member for receiving one side edge of the sheet moved in the crossing direction by the cross-directionally moving device, and restricting the movement of the sheet, and the cross-directionally moving device decelerates the movement speed of the sheet and causes the sheet to abut against the cross-side restricting member.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIG. 13A shows a state in which the first sheet has been discharged. FIG. 13B shows a state in which the side edge alignment of the first sheet has been effected. FIG. 13C shows a state in which a succeeding sheet has been discharged. FIG. 13D shows the standby position of the offset rollers when $L3 \geqq W$.

FIG. 14A shows a state in which the first sheet has been discharged. FIG. 14B shows a state in which the side edge alignment of the first sheet has been effected. FIG. 14C shows a state in which a succeeding sheet has been discharged.

DESCRIPTION OF THE PREFERRED EMBODIMENTS

A sheet processing apparatus according to an embodiment of the present invention will hereinafter be described with reference to the drawings.

Figure 1:
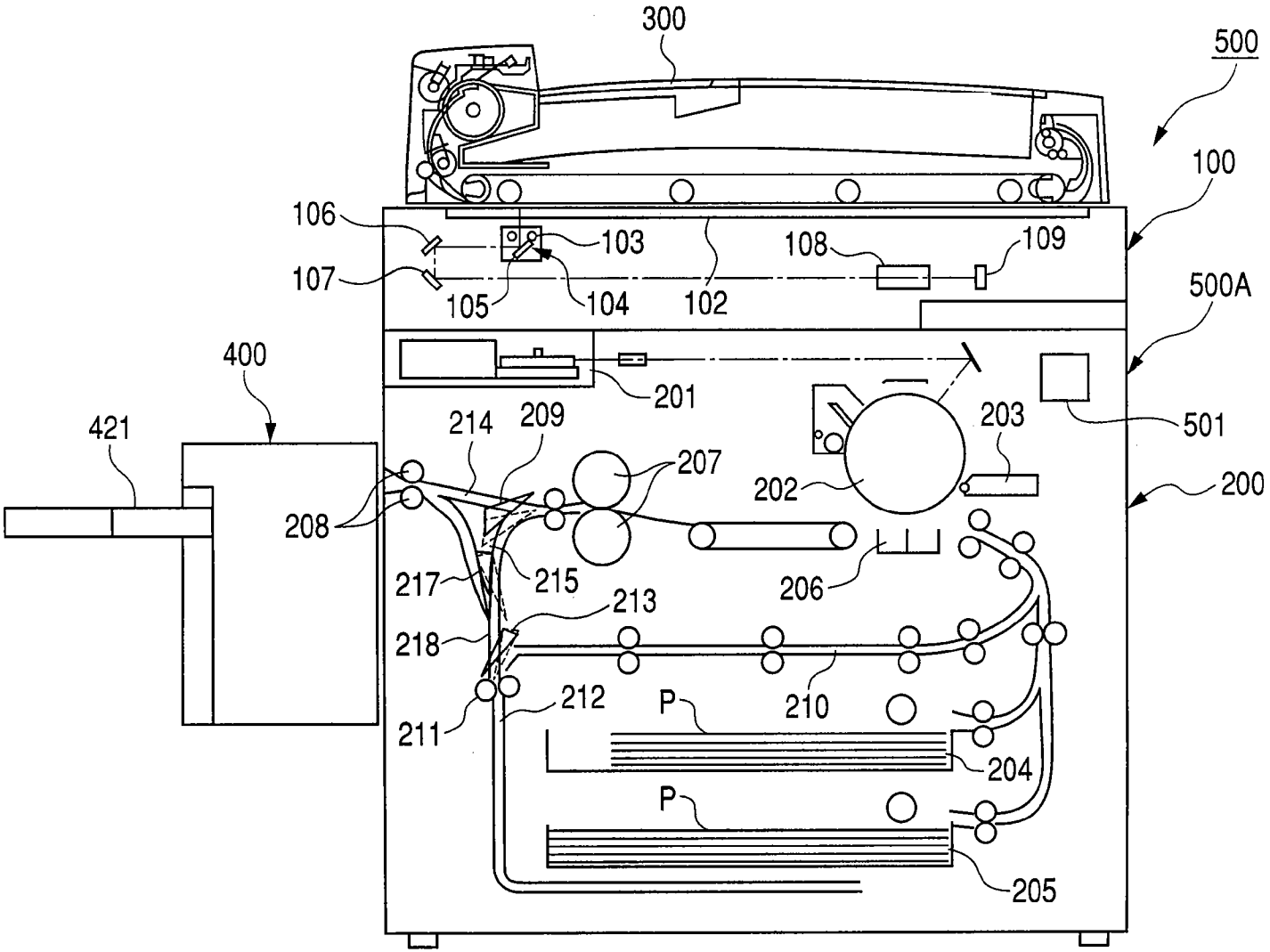
FIG. 1 is a schematic front cross-sectional view of a copying machine which is an example of an image forming apparatus provided with a sheet processing apparatus according to an embodiment of the present invention in an apparatus main body.

FIG. 1 is a schematic front cross-sectional view of a copying machine which is an example of an image forming apparatus provided with the sheet processing apparatus of the present invention in an apparatus main body. Image forming apparatuses include a copying machine, a facsimile apparatus, a printer and a compound machine of these. Accordingly, the sheet processing apparatus of the present invention is not connected to only the apparatus main body of a copying machine. Also, the sheet processing apparatus may be incorporated in the apparatus main body of an image forming apparatus.

The sheet processing apparatus according to the present embodiment is provided with a stapler for binding a sheet bundle, but may be provided with a punching device for punching a sheet, instead of the stapler.

(Copying Machine)

The copying machine 500 is comprised of a reader portion 100, a printer portion 200, a sheet processing apparatus 400, etc. In the upper portion of the copying machine 500, there is provided an automatic document feeder 300 (hereinafter referred to as the "ADF") for supplying documents one by one onto platen glass 102. The sheet processing apparatus 400 for effecting post-processing on a sheet discharged from the apparatus main body 500A of the copying machine 500 is connected to a side of the apparatus main body 500A of the copying machine 500.

In FIG. 1, the reader portion 100 is adapted to convert a document into image data. The printer portion 200 has plural types of sheet cassettes 204 and 205 stacking a plurality of sheets thereon, and is adapted to form image data as a visible image on the sheet by a print command.

The reader portion 100 conveys a document to a predetermined position on the platen glass 102 and passes the document through that position by the ADF 300 and at the same time, applies the light of the lamp 103 of a scanner unit 104 stopped at the predetermined position, or applies the light of the lamp 103 of the horizontally moved scanner unit 104 to the document placed on the platen glass 102 with the ADF 300 opened by a user.

Reflected light from the document is inputted to a CCD image sensor portion 109 via mirrors 105, 106, 107 and a lens 108. The reflected light from the document applied to the CCD image sensor portion 109 is subjected to electrical processing such as photoelectric conversion by the CCD image sensor portion 109, and is subjected to ordinary digital processing. Thereafter, the image signal is inputted to the printer portion 200.

The image signal inputted to the printer portion 200 is modulated and converted into an optical signal by an exposure controlling portion 201, and irradiates a photosensitive member 202 (constituting an image forming portion). A latent image formed on the photosensitive member 202 by this irradiating light is toner-developed into a toner image by a developing device 203. In timed relationship with the leading edge of the toner image, a sheet is conveyed from one of sheet cassettes 204 and 205, and the toner image is transferred to the sheet by a transferring portion 206. This transferred toner image is fixed on the sheet by a fixing portion 207. The sheet on which the toner image has been fixed is discharged from a sheet discharging portion 208 to the outside of the apparatus main body 500A of the copying machine 500 via a path 214. Thereafter, the sheet is subjected to sorting, binding, etc. in accordance with an operation mode designated in advance by the sheet processing apparatus 400.

Description will now be made of the sequence in which images successively read in are formed on the two sides of a sheet.

A sheet having a toner image fixed on one side thereof by the fixing portion 207 is guided to paths 215 and 218 by direction changeover members 209 and 217 held at solid-line positions, and is guided to a reversing path 212 by a direction changeover member 213 held at a broken-line position. After the trailing edge of the sheet has passed the direction changeover member 213, the direction changeover member 213 is changed over to a solid-line position to thereby reverse the rotation direction of a roller 211, whereupon the sheet has its conveying direction reversed and is reversed, and then is conveyed to an image-transferred sheet stacking portion 210. Then, the sheet is conveyed to the photosensitive member 202. When the next document is prepared on the platen glass 102, the image of the document is read in the same manner as the above-described process, but the sheet is supplied from the image-transferred sheet stacking portion 210 and therefore, after all, the images of two documents can be formed on the front side and back side of one and the same sheet.

(Sheet Processing Apparatus)

Figure 2:
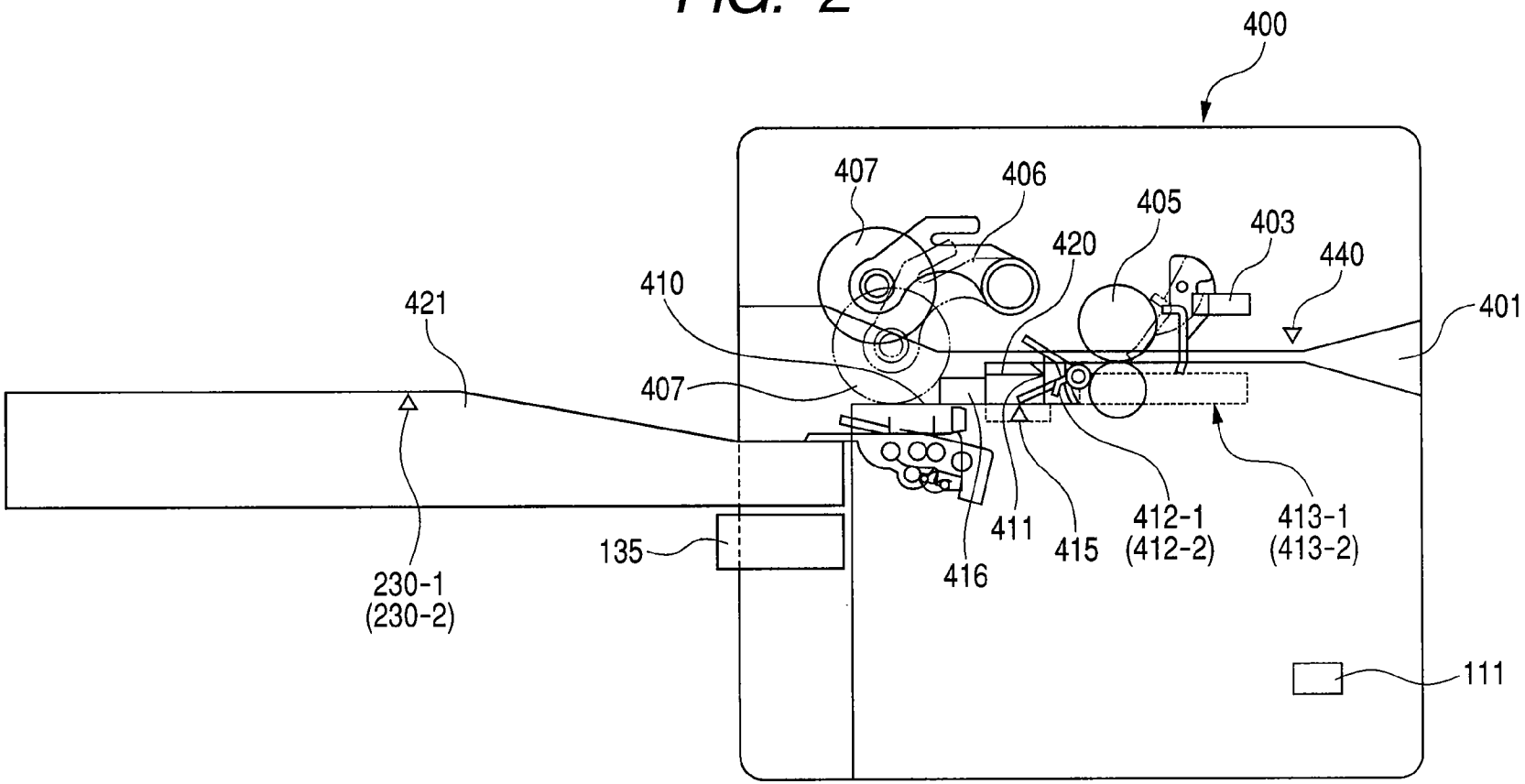
FIG. 2 is a schematic front cross-sectional view of the sheet processing apparatus according to the embodiment of the present invention.
Figure 3A:
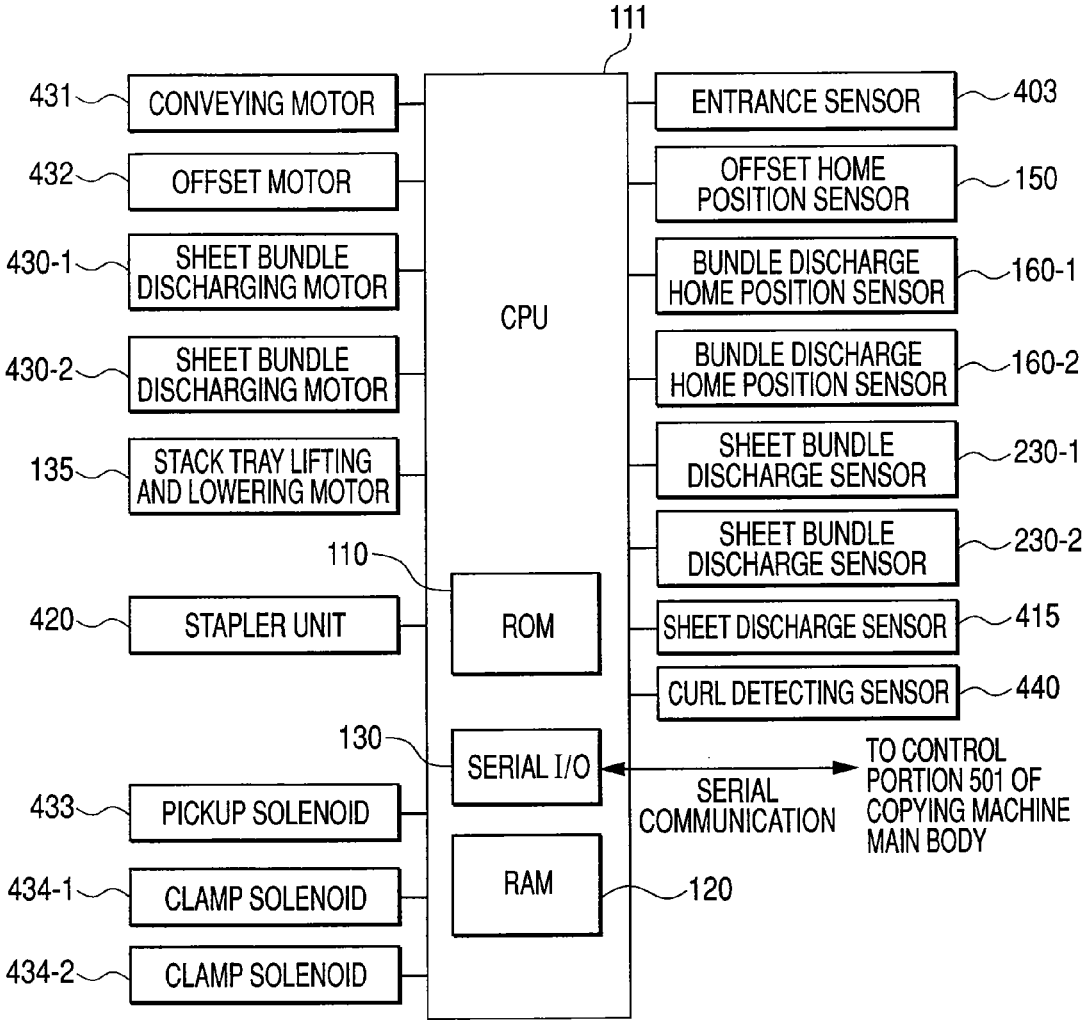
FIG. 3A is a block diagram showing the connected relationships among the controlling portion of the sheet processing apparatus according to the embodiment of the present invention, sensors, motors, etc.

FIG. 2 is a schematic front cross-sectional view of the sheet processing apparatus 400. FIG. 3A is a block diagram showing the connected relationships among the controlling portion of the sheet processing apparatus, sensors, motors, etc.

The sheet processing apparatus 400 is provided with a sheet receiving portion 401 for receiving the sheet discharged from the apparatus main body 500A of the copying machine 500, conveying rollers 405 (sheet discharging members) for conveying the sheet, a post-processing tray 410 (sheet stacking portion) for containing therein the sheets successively discharged by the conveying rollers 405, offset rollers 407 for conveying the sheets on the post-processing tray 410, a stacking tray 421 for finally stacking thereon a sheet bundle formed on the post-processing tray 410, a CPU (controlling portion) 111 for controlling the sheet processing apparatus 400 on the basis of a control signal from a controlling portion 501 (see FIG. 1) in the apparatus main body 500A, sensors 403, 150, 160-1, 160-2, 230-1, 230-2, 415 and 440, motors 431, 432, 430-1, 430-2 and 135, solenoids 433, 434-1 and 434-2, and a stapler unit 420 for binding the sheet bundle, and the sheet processing apparatus 400 is designed to form a bundle of a number of sheets corresponding to the number of documents on the post-processing tray 410, and discharge each sheet bundle onto the stacking tray 421.

The stapler unit 420 need not always be provided.

While in the present embodiment, the controlling portion 501 of the apparatus main body is provided in the apparatus main body 500A, and the CPU 111 is provided in the sheet processing apparatus 400, the controlling portion 501 and the CPU 111 may be made integral with each other, and be provided in one of the apparatus main body 500A and the sheet processing apparatus 400.

While in the present embodiment, the sheet processing apparatus 400 is connected to the apparatus main body 500A of the copying machine 500, the sheet processing apparatus according to the present invention may be incorporated in the interior of the apparatus main body 500A of the copying machine 500. In that case, the sheet discharged from the sheet discharging portion 208 may be directly received by the offset rollers 407.

Figure 5:
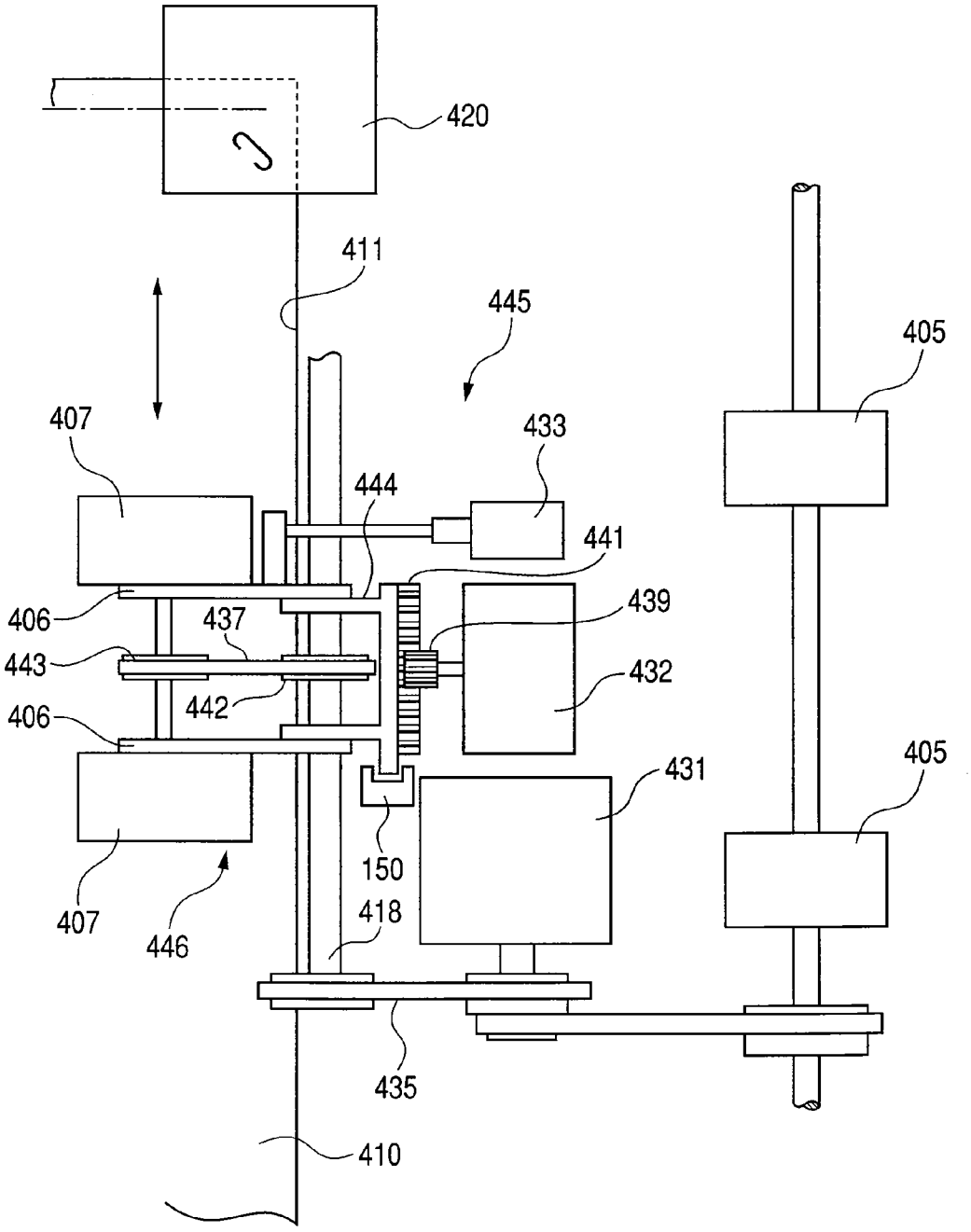
FIG. 5 is a schematic plan view of the driving mechanism of the offset rollers and conveying rollers of the sheet processing apparatus according to the embodiment of the present invention.

FIG. 5 is a schematic plan view of the driving mechanism of the offset rollers and conveying rollers of the sheet processing apparatus according to the embodiment of the present invention. In FIG. 5, an offset motor 432, a pinion 439, a rack 441, a rack supporting member 444, a square shaft 418, offset roller arms 406 and the offset rollers 407 together constitute a cross-directionally moving device 445.

The cross-directionally moving device 445 is adapted to move the offset roller arms 406 to an offset home position 416*d* (see FIG. 9) and a position for moving the sheet to a side edge aligning position which will be described later in a direction crossing a sheet discharging direction.

The position in which the offset rollers 407 start movement is not always the offset home position 416*d*. That is, as will be described later, it sometimes differs from the offset home position depending on the sheet size. Also, it sometimes differs from the offset home position when the sheet is curled.

Also, the conveying motor 431, a belt 435, the square shaft 418, pulleys 442, 443, a belt 437, the offset roller arms 406 and the offset rollers 407 together constitute a conveying direction moving apparatus (conveying direction moving means) 446 for selectively moving the sheet to a downstream side and an upstream side in the sheet discharging direction.

In FIG. 3A, the CPU 111 has a ROM 110. The ROM 110 stores therein a program corresponding to a control procedure described in a flow chart shown in FIGS. 8A, 8B and 8C. The CPU 111 is adapted to read out and execute the program stored in the ROM 110, and effect the control of each portion. Also, the CPU 111 has a RAM 120. The RAM 120 stores therein operating data 121 shown in FIG. 3B. The CPU 111 is adapted to control each portion on the basis of the operating data 121.

Figure 6:
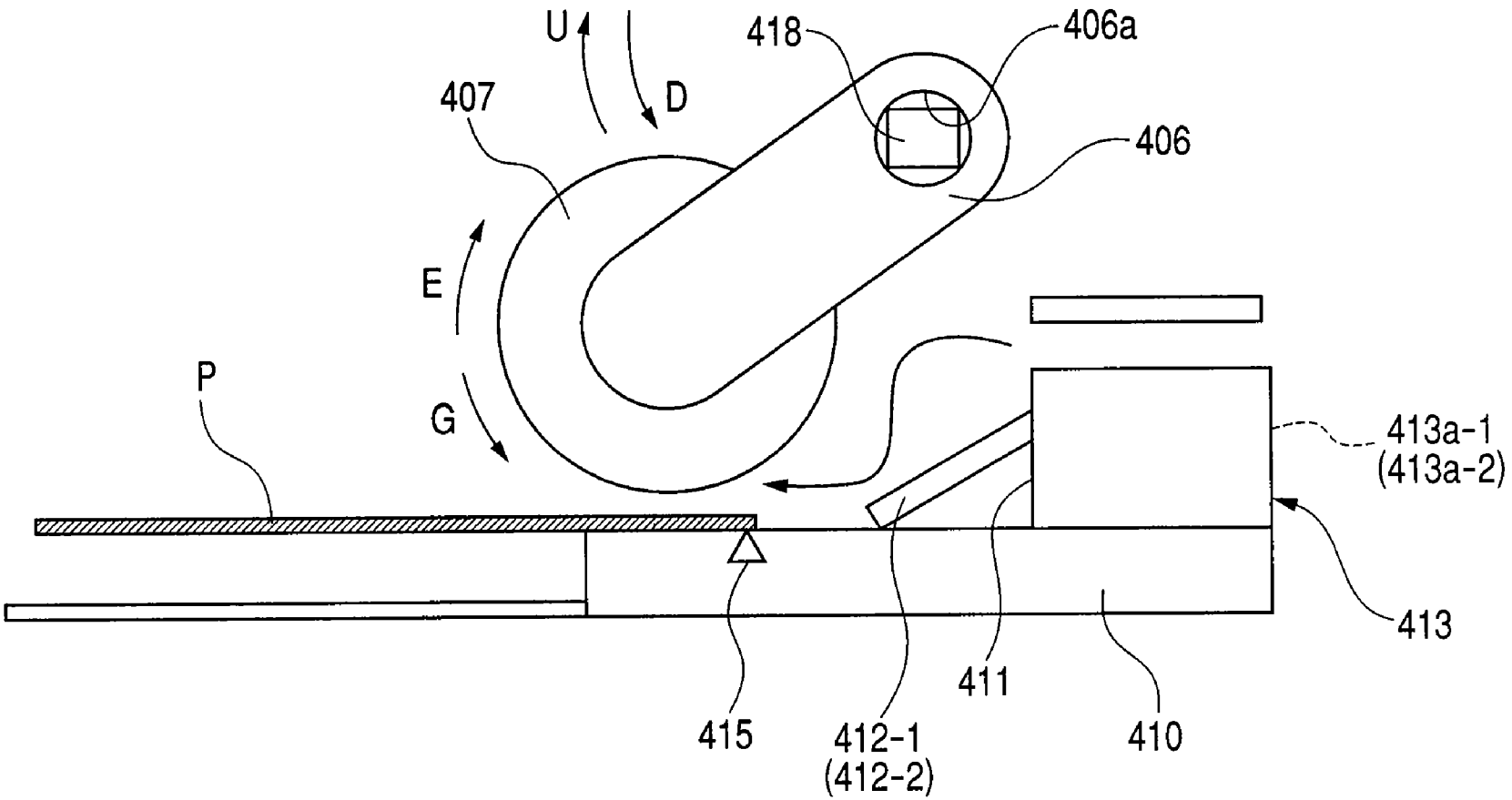
FIG. 6 is a schematic front view showing the arrangement relationships among the offset rollers, the clamp mechanism and the post-processing tray of the sheet processing apparatus according to the embodiment of the present invention.
Figure 7:
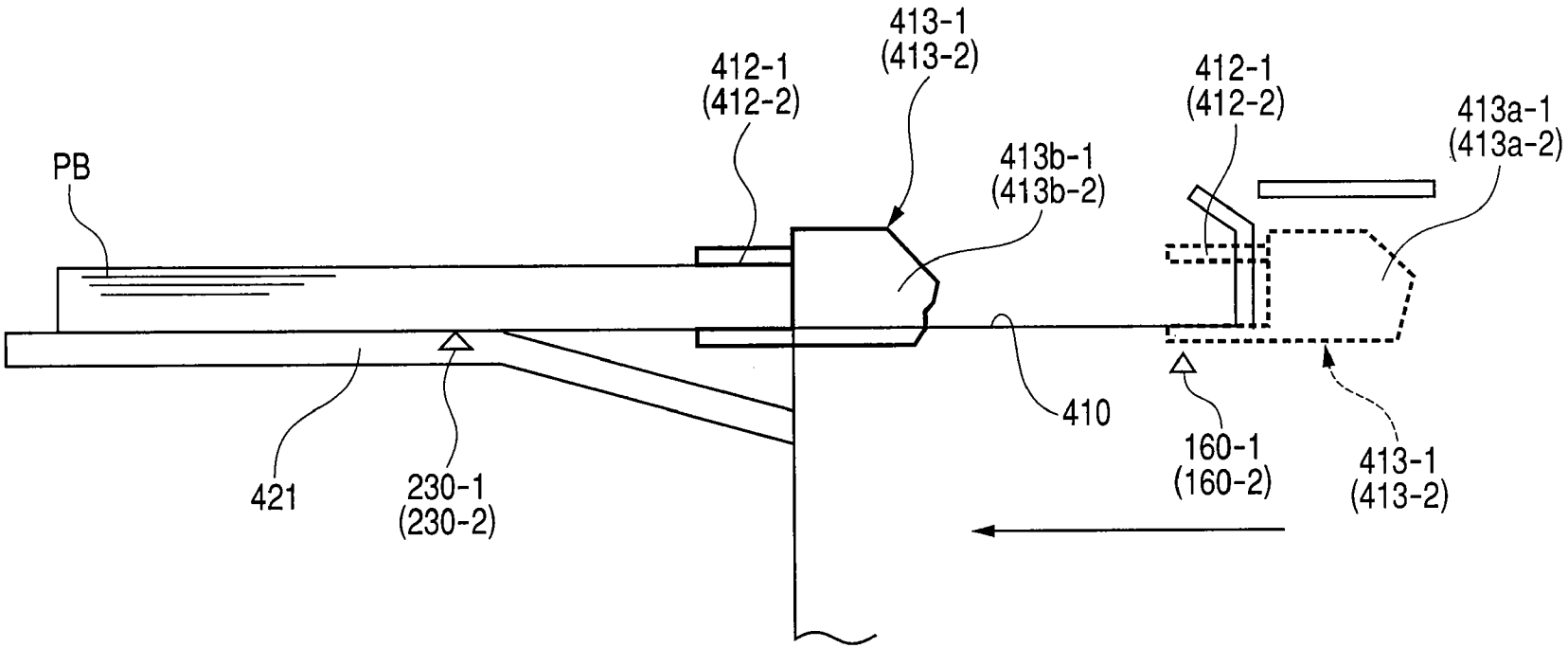
FIG. 7 is an illustration of the moving operation of the clamp mechanism of the sheet processing apparatus according to the embodiment of the present invention.

The input port of the CPU 111 has connected thereto such sensors as an entrance sensor 403 for detecting the sheet conveyed from the apparatus main body 500A of the copying machine 500 to a sheet receiving portion 401 shown in FIG. 2, an offset home position sensor 150 for detecting whether the offset rollers 407 shown in FIG. 5 are in the offset home position 416*d*, bundle discharge home position sensors 160-1 and 160-2 for detecting whether clamp mechanisms 413-1 and 413-2 shown in FIG. 7 are in home positions 413*a*-1 and 413*a*-2, respectively, sheet bundle discharge sensors 230-1 and 230-2 for detecting whether a sheet bundle has been discharged to the stacking tray 421 shown in FIG. 2, a sheet discharge sensor 415 for detecting whether the sheets have been discharged to and stacked on the post-processing tray 410 shown in FIG. 6, and a curl detecting sensor 440 shown in FIG. 2 for detecting the curl of the sheet.

The sheet processing apparatus 400 need not always be provided with the curl detecting sensor 440.

Figure 9:
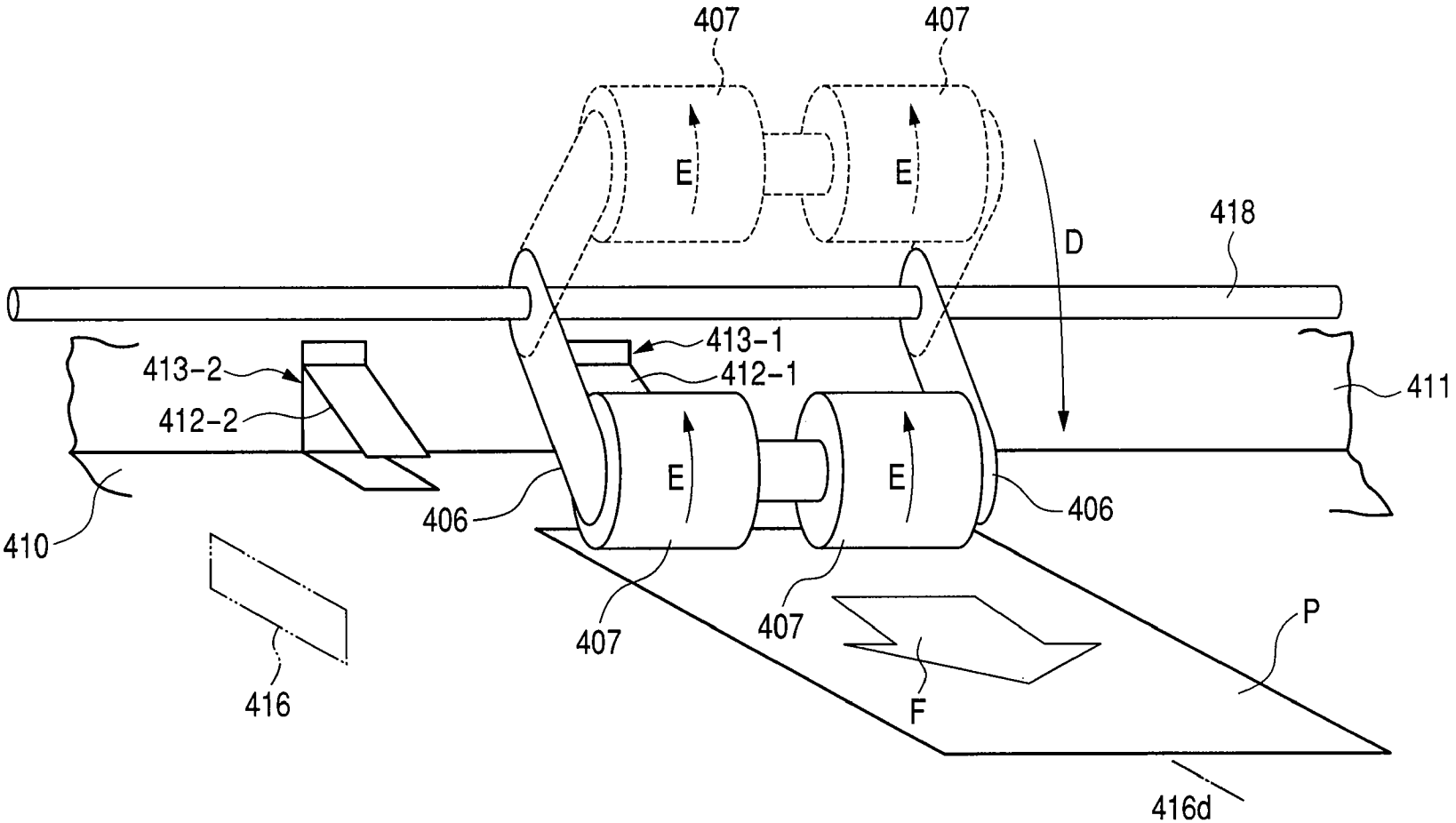
FIG. 9 is a perspective view of the offset roller, etc. when, in the sheet processing apparatus according to the embodiment of the present invention, a sheet has been discharged onto a post-processing tray.

The CPU 111 is adapted to execute the program stored in the ROM 110, on the basis of the detection signals of these sensors, and control motors, solenoids and the stapler unit 420 connected to an output port. The motors include a conveying motor 431 for rotating the offset rollers 407 shown in FIG. 5 in a direction to convey the sheet to the downstream side and a direction to convey the sheet to the upstream side, an offset motor 432 for moving the offset rollers 407 shown in FIG. 5 in the direction crossing the sheet discharging direction, sheet bundle discharging motors 430-1 and 430-2 for moving the clamp mechanisms 413-1 and 413-2 shown in FIG. 4 to a bundle discharging home position and a sheet bundle discharging position, respectively, and a stacking tray lifting and lowering motor 135 for lifting and lowering the stacking tray 421 shown in FIG. 2. The solenoids include a pickup solenoid 433 for lifting and lowering the offset rollers 407 shown in FIG. 5, and clamp solenoids 434-1 and 434-2 for opening and closing clamp claws 412-1 and 412-2, respectively, shown in FIG. 4. The offset home position 416*d* shown in FIG. 9 is also a sheet discharging position which will be described later.

The CPU 111 is provided with a serial interface portion 130. The CPU 111 is adapted to give and receive control data and a control signal to and from the controlling portion 501 of the apparatus main body 500A by this serial interface portion 130, and effect the control of each portion.

Figure 4:
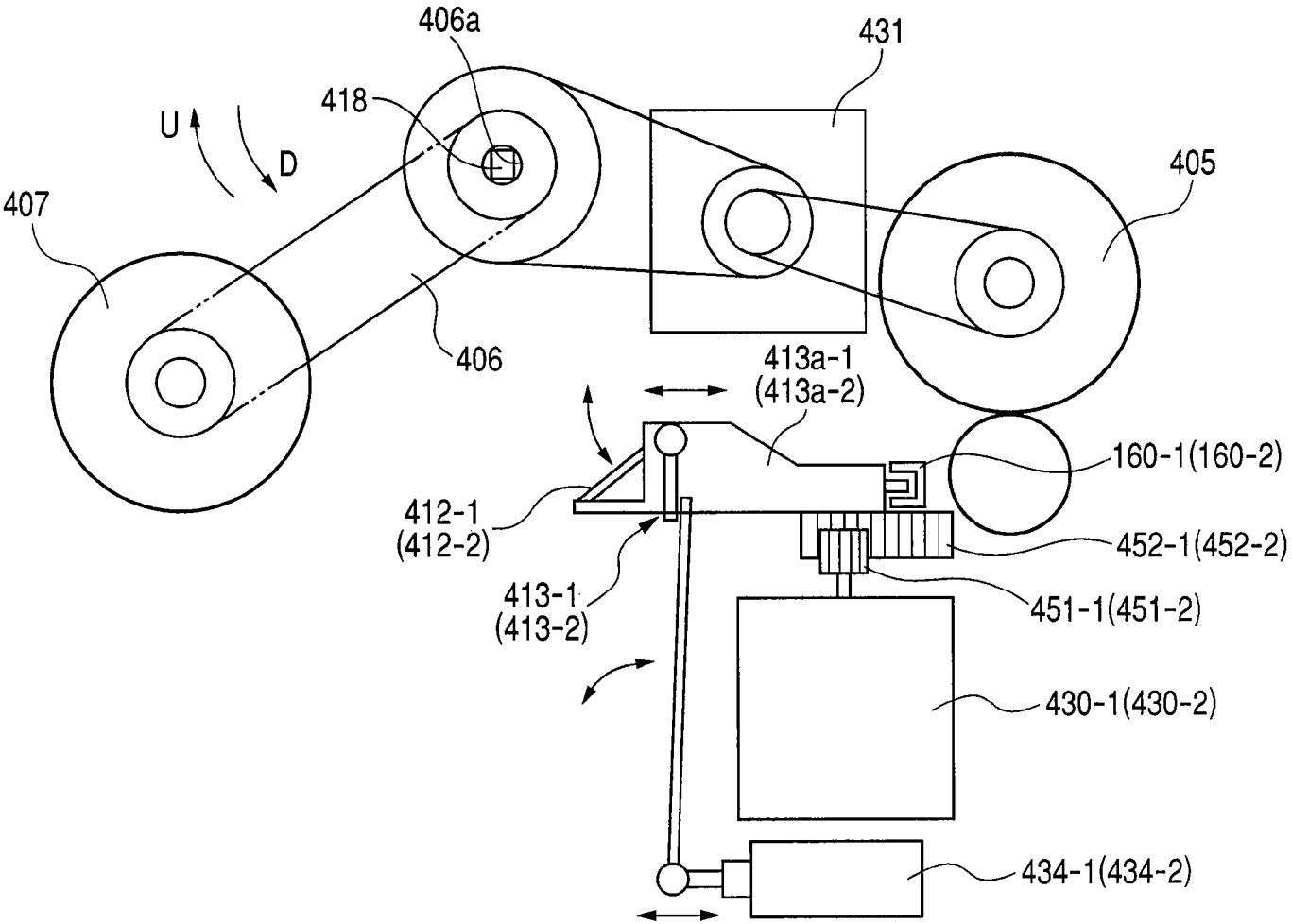
FIG. 4 is a schematic front view of the driving mechanism of the offset roller and conveying roller of the sheet processing and the driving mechanism of the clamp mechanism of the sheet processing apparatus according to the embodiment of the present invention.

FIGS. 4 to 6 show the driving mechanism of the offset rollers 407. The offset rollers 407 are supported by the offset roller arms 406 movable up and down and rotatable in the directions indicated by the arrows U and D so as to be capable of receiving the sheet on the post-processing tray 410. The offset roller arms 406 are rotatably supported on the square shaft 418 having a square cross-sectional shape by a round hole 406*a*. The offset roller arms 406, in order to make their construction readily understood, is shown as being disposed outside the pair of offset rollers 407 in FIG. 6 and FIGS. 9, 10, 11 and 12 which will be described later, but actually is disposed between the pair of offset rollers 407, as shown in FIG. 5.

The offset roller arms 406 are adapted to be lifted and lowered by the pickup solenoid 433 through a down lever. The offset rollers 407 are adapted to be rotated by the conveying motor 431 through the belt 435, the square shaft 418, the pulley 442, the belt 437 and the pulley 443. The conveying motor 431 is adapted to rotate the conveying roller 405 and the offset rollers 407 by an amount according to the amount of rotation in the sheet discharging direction or a direction opposite to the sheet discharging direction. The pulley 442 is provided on the square shaft 418 by a square hole (not shown), and is adapted to be rotated integrally with the square shaft 418 by the engagement between the square hole and the square shaft 418 and be movable on the square shaft 418 in a thrust direction.

Between the pair of offset roller arms 406, the rack supporting member 444 of a U-shape as viewed in plan view having the rack 441 is supported by and disposed on the square shaft 418. The rack supporting member 444 is rotatably provided on the square shaft 418 by a round hole (not shown). Therefore, the rack supporting member 444 is adapted to be not driven to rotate by the square shaft 418 even if the square shaft 418 is rotated, and be movable on the square shaft 418 in the thrust direction. The pinion 439 provided on the fixed offset motor 432 is in meshing engagement with the rack 441. The pickup solenoid 433 is movable along the square shaft 418.

Accordingly, the belt 437, the pulley 443, the offset roller arms 406 and the offset rollers 407 are adapted to be capable of being lifted and lowered and rotated in the directions indicated by the arrows U and D in FIG. 4 about the square shaft 418, and also be guided by the square shaft 418 and be movable toward and away from the stapler unit 420 with the movement of the rack supporting member 444.

The offset rollers 407 (see FIGS. 2 and 6) are adapted to be lowered from gravity by the pickup solenoid 433 shown in FIG. 5 becoming OFF when the leading edge of the sheet is conveyed to the post-processing tray 410 and the trailing edge of the sheet is detected by the entrance sensor 403, and urge the upper side of the sheet and convey the sheet to the downstream side so that the entire sheet may be stacked on the post-processing tray 410. Also, the offset rollers 407 are adapted to convey the sheet to the post-processing tray 410, and thereafter be stopped and rotated in the opposite direction to thereby abut the upstream edge of the sheet against a trailing edge stopper (upstream edge aligning means) 411, and effect the alignment of the upstream edge. Further, the offset rollers 407, when in FIG. 5, the offset motor 432 is rotated, is adapted to be movable toward a side edge aligning position which will be described later by the pinion 439 and the rack 441. The reason why the offset rollers 407 are moved toward the side edge aligning position is for causing the sheet to be driven to move by the offset rollers 407 by the utilization of the frictional contact of the offset rollers 407 with the sheet to thereby move the sheet to the side edge aligning position.

FIGS. 4, 6 and 7 are views for illustrating the construction of the clamp mechanisms 413-1 and 413-2. The clamp mechanisms 413-1 and 413-2 installed near the trailing edge stopper 411 are adapted to be movable toward and away from the stacking tray 421 by the pinions 451-1, 451-2 and the racks 452-1, 452-2 when the sheet bundle discharging motors 430-1 and 430-2 are rotated. That is, the clamp claws 412-1, 412-2 and the clamp solenoids 434-1, 434-2 are adapted to be moved. The clamp claws 412-1 and 412-2 of the clamp mechanisms 413-1 and 413-2, respectively, are adapted to be opened and closed in the directions indicated by the arrows indicated in FIG. 4 by the actuation of the clamp solenoids 434-1 and 434-2.

In the above-described construction, the controlling portion 501 of the apparatus main body 500A of the copying machine 500 to which the sheet processing apparatus 400 shown in FIG. 1 is attached grasps the size of the sheet discharged from the sheet discharging portion 208.

Therefore, the CPU 111 of the sheet processing apparatus 400 which comprises a microcomputer system effects serial communication with the controlling portion 501 of the apparatus main body 500A.

The sheet side edge aligning operation will now be described with reference to FIGS. 9 to 11, 13A to 13D, 14A to 14C and 15.

Figure 15:
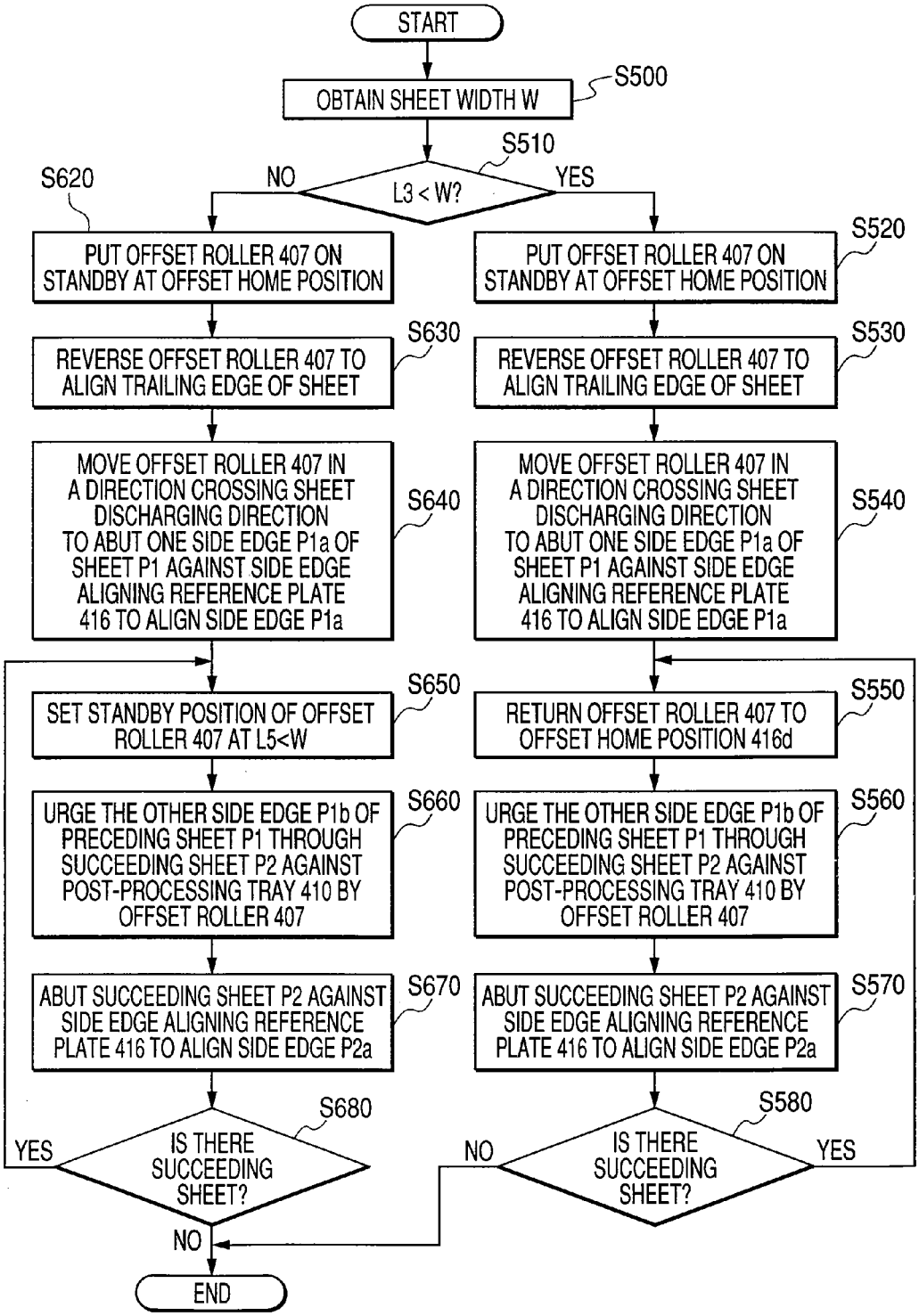
FIG. 15 is a flow chart schematically showing the control of the offset rollers by a CPU.

The CPU 111 is adapted to control the offset motor 432, and move the offset rollers 407 to the standby position when they receive the sheet, in accordance with the width size of the sheets stacked on the post-processing tray 410. The width size of the sheets is sent from the controlling portion 501 of the apparatus main body 500A of the copying machine 500, or from a sensor (not shown) provided in the course until the sheet is discharged to the post-processing tray 410 (FIG. 5). FIG. 15 is a flow chart schematically showing the control of the offset rollers 407 by the CPU 111. The CPU 111 obtains the data of the sheet width W from the controlling portion 501 or the sensor (not shown) (S500).

Figure 10:
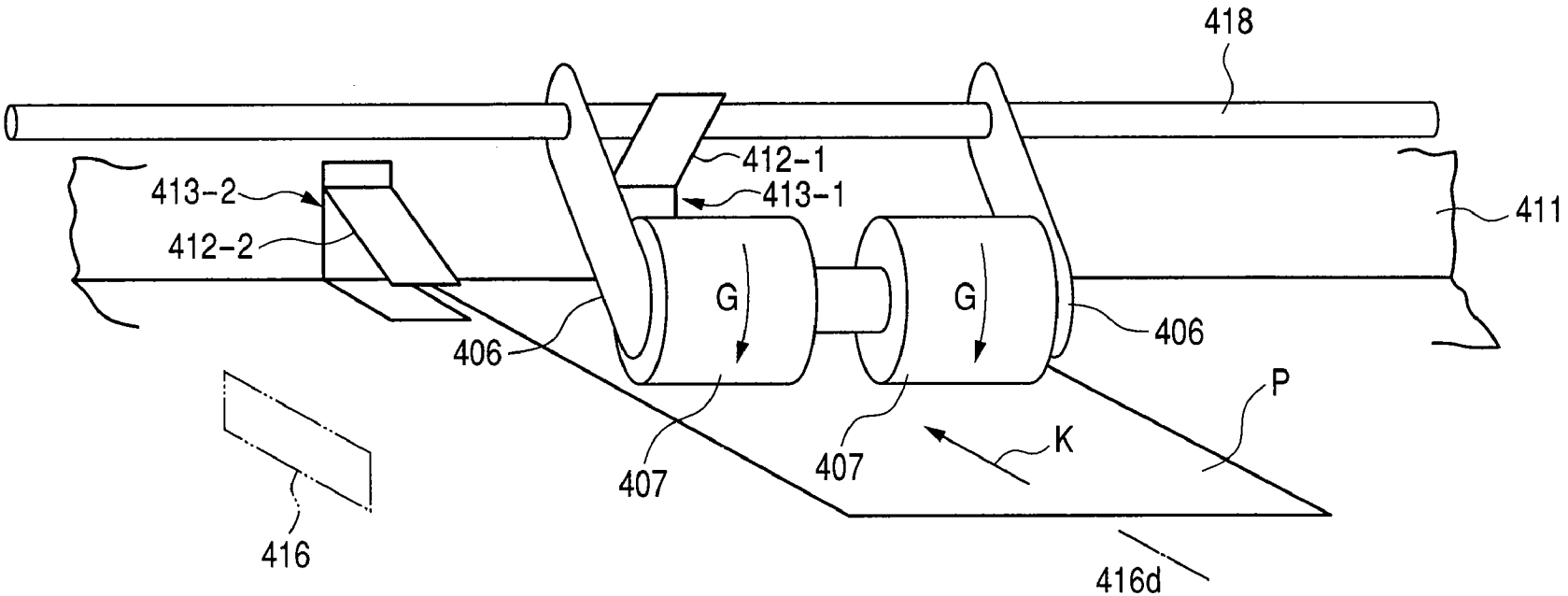
FIG. 10 is a perspective view of the offset rollers, etc. when, in subsequence to FIG. 9, the offset rollers have moved the sheet to a trailing edge stopper.
Figure 13A:
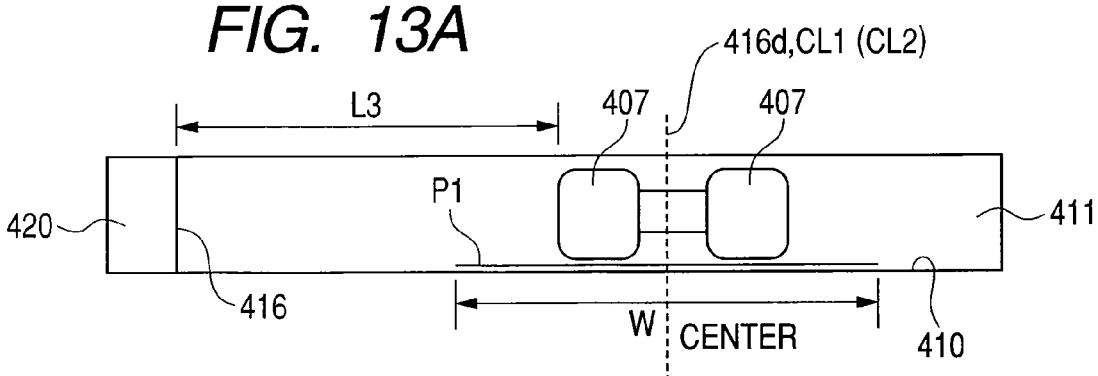
FIGS. 13A, 13B, 13C and 13D are illustrations of the sheet side edge aligning operation of the offset rollers.

The sheet is discharged onto the post-processing tray 410 by the conveying rollers 405 (FIG. 5) so that the center of the sheet width W may substantially align with the center (the position indicated by the reference character 416*d* in FIG. 10) of the post-processing tray 410. The sheet width W refers to the length of the sheet along the direction crossing the sheet discharging direction. The standby position of the offset rollers 407 is usually substantially the center of the post-processing tray 410, as shown in FIGS. 10 and 13A, and is adapted to receive the inserted sheet at the center. That is, as shown in FIG. 13A, usually the width center CL1 of the sheet conveyed out by the conveying rollers 405, the width center CL2 of the offset rollers 407 and a position indicated by the offset home position 416*d* (FIG. 9) align with one another.

The CPU 111 judges on the basis of sheet size information whether L3<W (S510). In FIGS. 13A to 13D, L1 is the width dimension of the post-processing tray 410. L2 is the width dimension of the offset rollers 407. L3 and L5 are the distances between a side edge aligning reference plate (cross-side restricting member) 416 and the offset rollers 407. W is the sheet width.

Figure 13B:
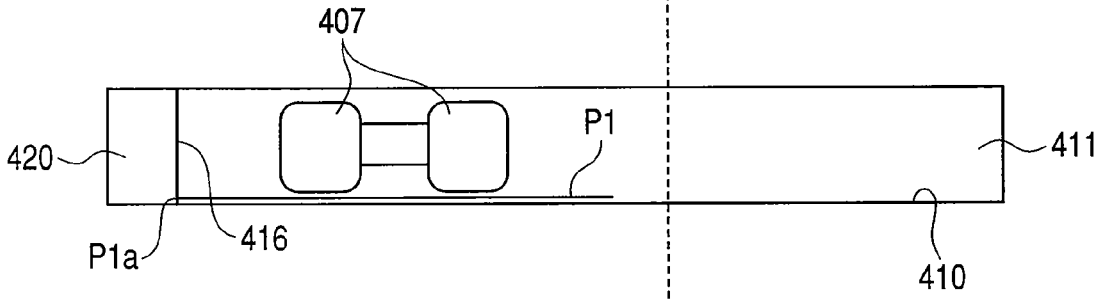

The CPU 111, when it judges that L3<W, does not change the position of the offset rollers 407. The offset rollers 407 stand by at the offset home position 416*d* (S520). In this case, the offset rollers 407, as shown in FIG. 13A, once move the sheet P1 discharged onto the post-processing tray 410 in the downstream direction, and thereafter are reversely rotated and convey the sheet P1 to the upstream side, and abut the trailing edge (the upstream side edge portion) of the sheet against the trailing edge stopper 411 to thereby align the trailing edge (S530). Then, the offset rollers 407, as shown in FIG. 13B, move the sheet P1 toward the side edge aligning reference plate 416 and abut one side edge P1*a* of the sheet P1 against the side edge aligning reference plate 416 to thereby align the side edge P1*a* (S540). Thereafter, the offset rollers 407 are returned to their original position (S550).

Figure 13C:
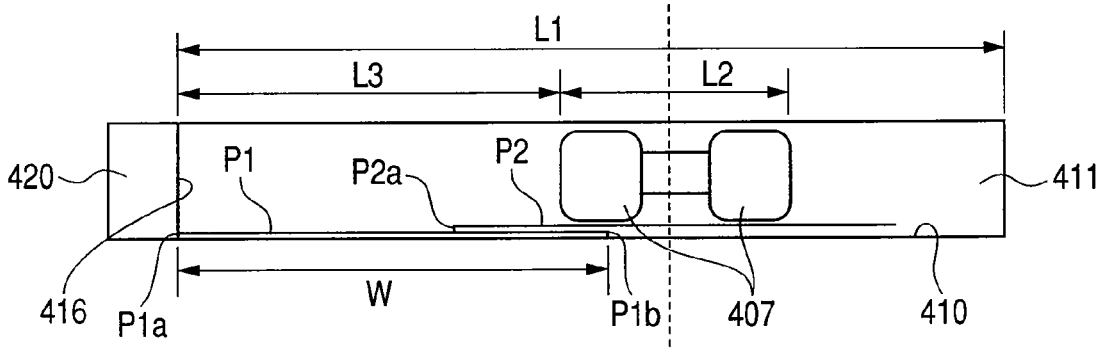

Subsequently, as shown in FIG. 13C, a succeeding (second) sheet P2 is discharged onto the post-processing tray 410 by the conveying rollers 405 (FIG. 5). At this time, the side edge portion of the succeeding sheet P2 discharged by the conveying rollers 405 and the side edge portion of the preceding sheet P1 are adapted to overlap each other. Since L3<W, the offset rollers 407 urges the other side edge P1*b* of the preceding sheet P1 against the post-processing tray 410 through the succeeding sheet P2 (S560). Therefore, the offset rollers 407 need not ride onto the other side edge P1*b* of the preceding sheet P1 when they move the succeeding sheet to the side edge aligning reference plate 416 side. Consequently, the offset rollers 407 do not disturb the alignment of the side edge of the preceding sheet P1. Nor they slide on the succeeding sheet P2. Consequently, the offset rollers 407 can cause the succeeding sheet P2 to accurately abut against the side edge aligning reference plate 416 to thereby align the side edge P2*a* (S570).

The CPU 111 judges whether there is a succeeding sheet (S580), and if there is a succeeding sheet, shift is made to a step S550, where the steps S550 to S580 are repeated. If at the step S580, it is judged that there is no succeeding sheet, the processing is terminated.

As described above, when L3<W, the offset rollers 407 can align the sheet with the side edge aligning reference plate 416 from a position in which the width center CL2 of the offset rollers 407 and the width center CL1 of the discharged sheet align with each other.

Figure 13D:
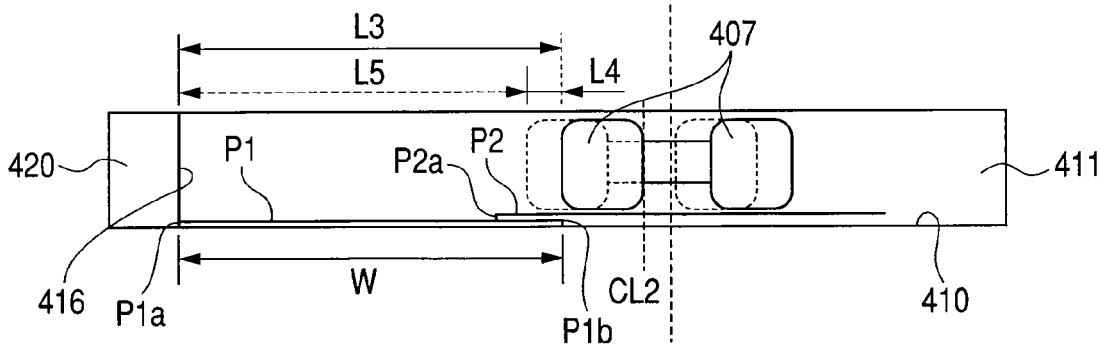

Now, when L3≧W as shown in FIG. 13D, the offset rollers 407 cannot urge the other side edge P1*b* of the preceding sheet P1 against the post-processing tray 410 through the succeeding sheet P2. In this case, the offset rollers 407 ride onto the other side edge P1*b* of the preceding sheet P1 through the succeeding sheet P2 and therefore, in some cases, there is the undesirable possibility that the offset rollers slide on the succeeding sheet P2 and cannot reliably align the side edge of the succeeding sheet P2. Therefore, the CPU 111 moves the offset rollers 407 by a distance L4 on the other side edge P1*b* of the preceding sheet P1, and sets the standby position of the offset rollers 407 to L5<W (S650). That is, the CPU 111 abuts one side edge P1*a* of the preceding sheet P1 against the side edge aligning reference plate 416 at steps S620, S630 and S640 in the same manner as at the aforedescribed steps S520, S530 and S540 to thereby align the side edge P1*a*, and thereafter changes the standby position of the offset rollers 407 from a solid-line position indicated in FIG. 13D to a broken-line position, and causes the offset rollers 407 to stand by above the other side edge P1*b* of the preceding sheet P1.

Subsequently, as shown in FIG. 13D, the succeeding (second) sheet P2 is discharged onto the post-processing tray 410 by the conveying rollers 405 (FIG. 5). At this time, the side edge portion of the succeeding sheet P2 discharged by the conveying rollers 405 and the side edge portion of the preceding sheet P1 are adapted to overlap each other. Since L5<W, the offset rollers 407 urge the other side edge P1*b* of the preceding sheet P1 against the post-processing tray 410 through the succeeding sheet P2 (S660).

The offset rollers 407 from a new standby position need not ride onto the other side edge P1*b* of the preceding sheet P1 to side-edge-align the succeeding sheet P2 with the side edge aligning reference plate 416, and can cause the succeeding sheet P2 to accurately abut against the side edge aligning reference plate 416 to thereby align the side edge P2*a* without disturbing the alignment of the side edge of the preceding sheet P1, and without sliding on the succeeding sheet P2 (S670).

The CPU 111 judges whether there is a succeeding sheet (S680), and if there is a succeeding sheet, shift is made to a step S650, where the steps S650 to S680 are repeated. If at the step S680, it is judged that there is no succeeding sheet, the processing is terminated.

Figure 14A:
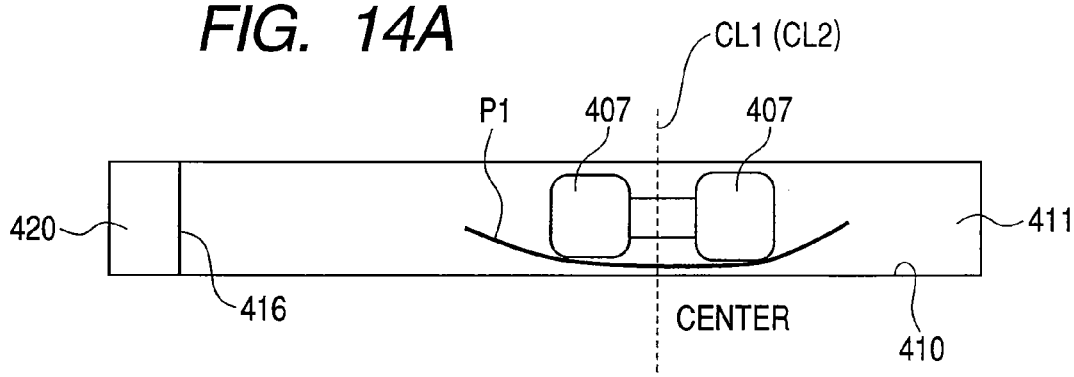
FIGS. 14A, 14B and 14C are illustrations of the side edge aligning operation of a curled sheet by the offset rollers.
Figure 14B:
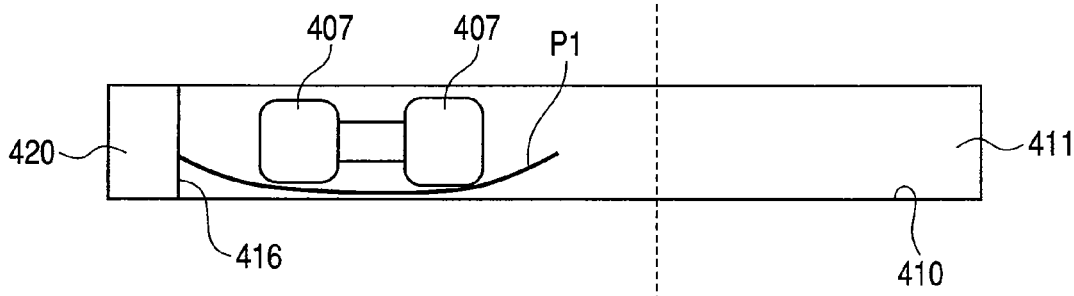
Figure 14C:
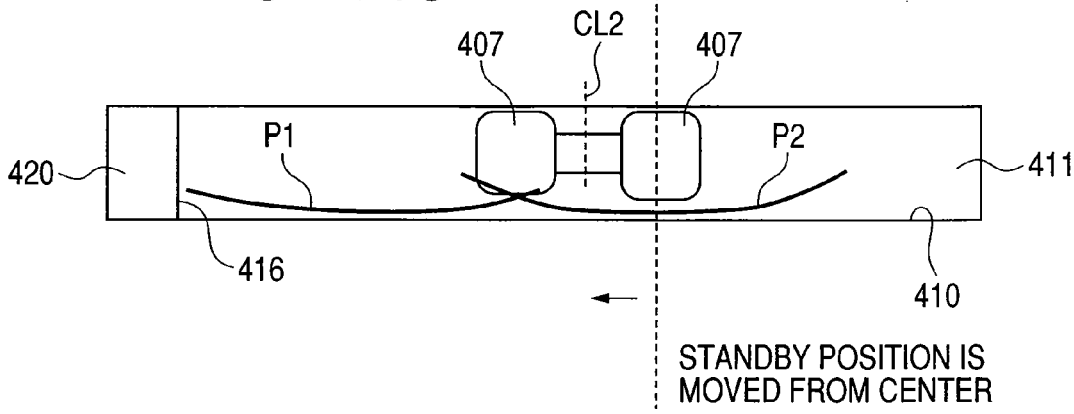

FIGS. 14A to 14C illustrate another embodiment in which the standby position is set on the basis of the amount of curl of the sheet.

If as shown in FIGS. 14A to 14C, the preceding sheet P1 is curled, the overhead width (the sheet width as it is seen from right above the sheet) becomes narrower by the amount of curl. Correspondingly, the standby position of the offset rollers 407 can be shifted to the side edge aligning reference plate 416 side. Depending on the amount of curl, the standby position need not be changed.

The preceding sheet P1 has its curl detected by the curl detecting sensor (curl detector) 440 provided between the sheet receiving portion 401 (FIG. 2) and the conveying rollers 405, during the time until it is discharged onto the post-processing tray 410. Even if as shown in FIG. 14A, the sheet is curled, in the case of the first sheet P1, the offset rollers 407 effect the side edge alignment of the sheet from a standby position in which the width center CL2 and the width center CL1 of the preceding sheet P1 align with each other. When the succeeding sheet P2 is then discharged, the CPU 111 shifts the standby position of the offset rollers 407 as shown in FIG. 14C in accordance with the amount of curl of the preceding sheet P1. Thereby, the offset rollers 407 can hold down the other side edge P1*b* of the preceding sheet P1, and need not ride onto the other side edge P1*b* of the preceding sheet P1, and can cause the succeeding sheet P2 to accurately abut against the side edge aligning reference plate 416 to thereby align the side edge P2*a* without disturbing the alignment of the preceding sheet P1, and without sliding on the succeeding sheet P2. The standby position of the offset rollers 407 may be changed with the sheet regarded as being curled. In this case, the curl detecting sensor 440 is not required.

As described above, the CPU 111 of the sheet processing apparatus 400 is adapted to grasp the sheet size of the sheet conveyed from the apparatus main body 500A of the copying machine 500, and control the offset motor 432 for moving the offset rollers 407 in the width direction, by an amount of movement according to the sheet size. That is, the CPU 111 is adapted to move the offset rollers 407 to a standby position adjusted to the sheet size and the state of the sheet.

Consequently, the sheet processing apparatus 400 according to the present embodiment is adapted to move the offset rollers 407 so as to move the next sheet P2 from the position between the other side edge P1*b* of the preceding sheet P1 received, for example, by the side edge aligning reference plate 416 which is the cross-side restricting member and the side edge aligning reference plate 416 to the side edge aligning reference plate 416. Therefore, the offset rollers 407 can hold down the other side edge P1*b* of the preceding sheet P1, and need not ride onto the other side edge P1*b* of the preceding sheet P1, and can cause the succeeding sheet P2 to accurately abut against the side edge aligning reference plate 416 to thereby align the side edge P2*a* without disturbing the alignment of the side edge of the preceding sheet P1, and without sliding on the succeeding sheet P2.

FIGS. 4 and 7 schematically show the construction of a sheet bundle discharging mechanism.

As shown in FIG. 9, a plurality of clamp mechanisms (holding means) 413-1 and 413-2 are provided in the sheet bundle discharging mechanism. The clamp mechanisms 413-1 and 413-2 are adapted to hold a sheet bundle PB aligned on the post-processing tray 410 (see FIGS. 5 and 7) by the aligning operation of the offset rollers 407 which will be described later and at the same time, intactly move the sheet bundle PB to bundle discharging positions 413*b*-1 and 413*b*-2 from home positions 413*a*-1 and 413*a*-2 toward the stacking tray 421 as shown in FIG. 7, to thereby discharge the sheet bundle from the post-processing tray 410 to the stacking tray 421. As shown in FIG. 4, the movement of the clamp mechanisms 413-1 and 413-2 is effected by sheet bundle discharging motors 430-1 and 430-2 rotating pinions 451-1 and 451-2 to thereby move racks 452-1 and 452-2. The home positions 413*a*-1 and 413*a*-2 of the clamp mechanisms 413-1 and 413-2, respectively, are adapted to be detected by bundle discharging home position sensors 160-1 and 160-2. Also, whether the sheet bundle has been discharged onto the stacking tray 421 is adapted to be detected by sheet bundle discharge sensors 230-1 and 230-2 provided on the stacking tray 421.

The sheet processing apparatus 400 (see FIG. 2) according to the present embodiment is adapted to lower the stacking tray 421 to a position in which the uppermost surface of the sheet bundle PB stacked on the stacking tray 421 substantially aligns with the post-processing tray 410 by a stacking tray lifting and lowering motor 135 when the sheet bundle PB is discharged from the post-processing tray 410 because the sheet bundle PB stacked on the stacking tray 421 constitutes a portion of the post-processing tray 410.

Figure 11:
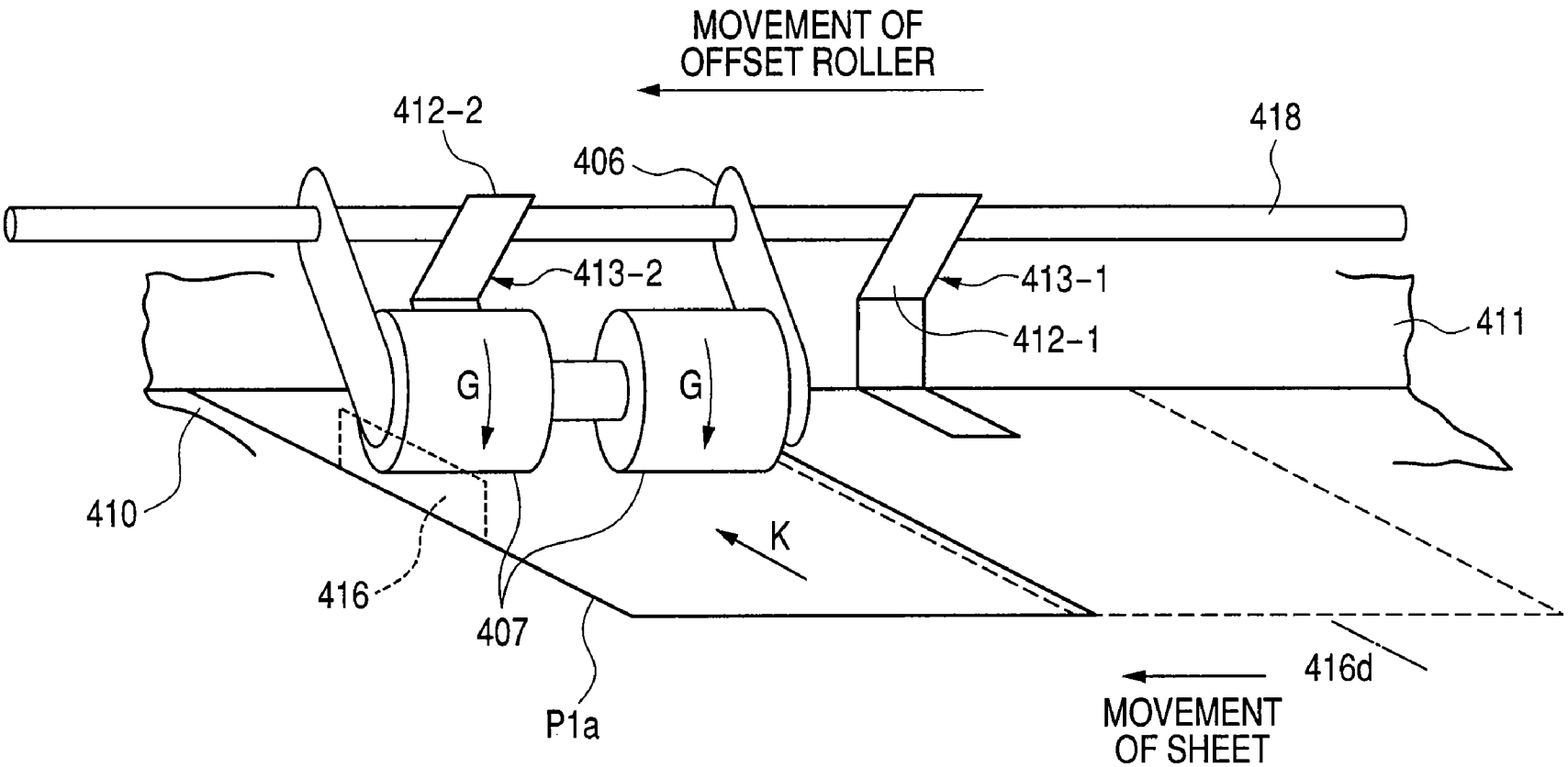
FIG. 11 is a perspective view of the offset rollers, etc. when the offset rollers have caused the sheet to abut against a side edge alignment reference plate.
Figure 12:
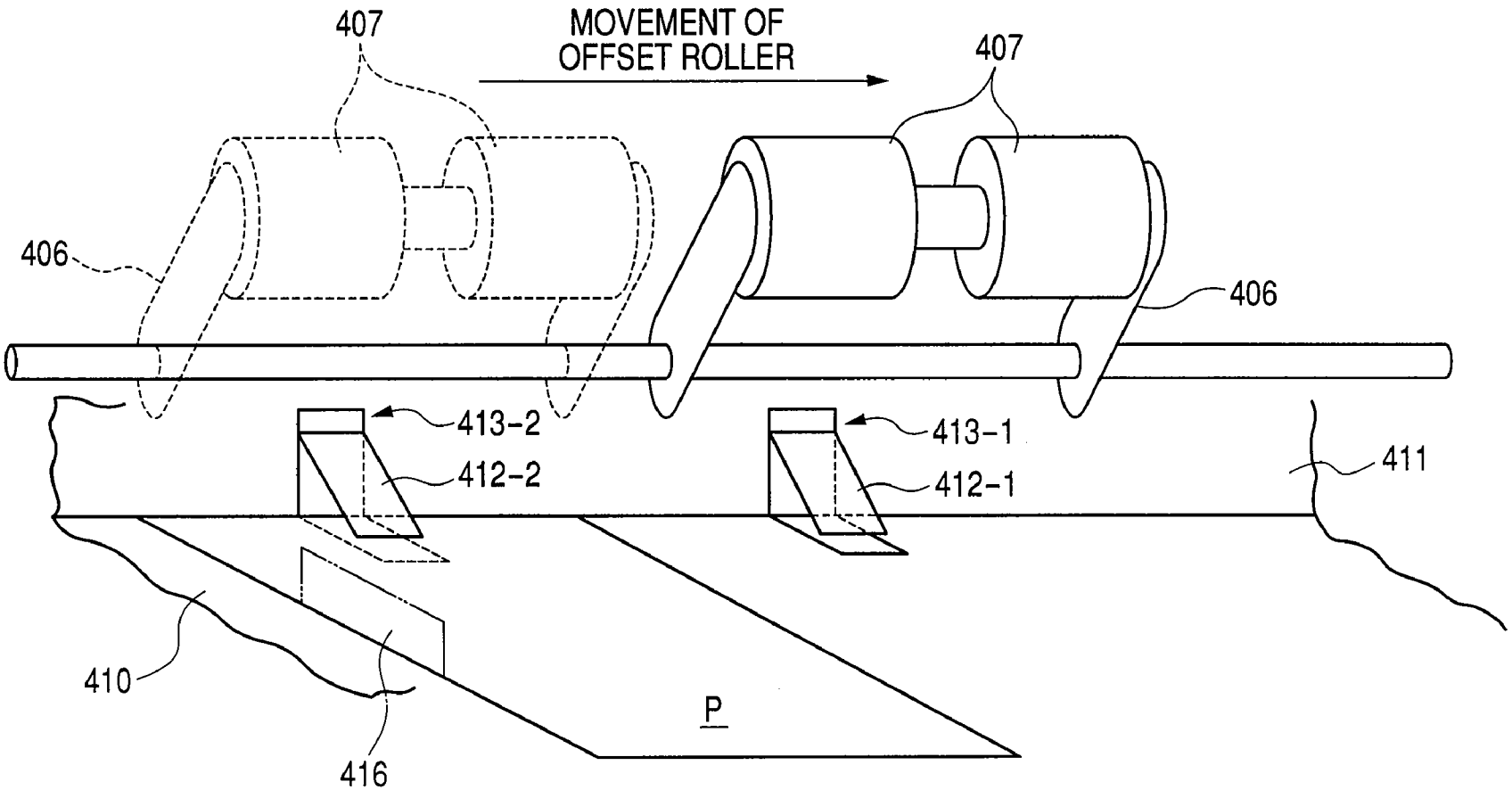
FIG. 12 shows a state in which in subsequence to FIG. 11, the offset rollers have been returned to their home position.

The operation of the sheet processing apparatus 400 according to the present embodiment will now be described with reference to the block diagram of FIG. 3, the flow chart shown in FIGS. 8A, 8B and 8C, FIGS. 1, 2, 4 to 7, and FIGS. 9 to 15. It is to be understood that this flow chart is a flow chart when as shown in FIG. 12, the sheets are stacked on one side of the post-processing tray 410. Also, the side edge aligning operation described with reference to FIGS. 13A to 13D and FIGS. 14A to 14C is performed at the same time, and the description thereof is as described with reference to FIG. 15.

When a copying operation is started in the apparatus main body 500A of the copying machine 500, the CPU 111 waits for a sheet discharging signal to be sent from the controlling portion 501 of the copying machine 500 (S100). The CPU 111, when it receives a sheet discharging signal from the controlling portion 501 through the serial interface portion 130, drives the pickup solenoid 433 shown in FIG. 5 to thereby rotate the offset roller arms 406 in the direction indicated by the arrow U indicated in FIGS. 4 and 6, and lift the offset rollers 407 (S110). The position to which the offset rollers 407 have been lifted is a position indicated by broken line in FIG. 9. The standby position of the offset rollers 407 is adjusted on the basis of the size information or the like of the sheet sent to the post-processing tray 410 (S115). As described with reference to FIG. 15, in the case of the first sheet, the CPU 111 causes the offset rollers 407 to stand by at the offset home position 416*d* (S520; S620). Also, in the case of the second and subsequent sheets, the CPU 111 basically causes the offset rollers 407 to stand by at a standby position set at a step S270 which will be described later.

Then, the CPU 111 rotates the conveying motor 431 to thereby rotate the conveying rollers 405 and the offset rollers 407 being rotated in the conveying direction in synchronism with the conveying rollers 405 in the direction indicated by the arrow E indicated in FIG. 9 so as to be capable of conveying the sheet in the same direction as the sheet discharging direction of the copying machine (S120). Thereby, the offset rollers 407 are lifted and rotated, and assumes a state in which it waits for the sheet to be conveyed thereto.

The CPU 111, when it receives a sheet entry detection signal having detected the trailing edge of the first sheet from the entrance sensor 403 (S130), releases the driving of the pickup solenoid 433, and lowers the offset rollers 407 in the direction indicated by the arrow D from gravity as indicated by solid line in FIG. 9, to thereby bring the offset rollers into pressure contact with the surface of the sheet (S140). When the sheet is the second or subsequent succeeding sheet P2, the CPU 111, as described with reference to FIG. 15, urges the other side edge P1*b* of the preceding sheet P1 against the post-processing tray 410 by the offset rollers 407 through the succeeding sheet P2 (S560; S660). The offset rollers 407 are already rotated in the direction indicated by the arrow E, and continues to be rotated by the conveying motor 431 to thereby convey the sheet in the direction indicated by the arrow F which is a downstream direction. The CPU 111, when the sheet is conveyed to a predetermined position beyond the clamp claw 412-1 shown in FIG. 6 (S150), stops the conveying motor 431 to thereby once stop the rotation of the offset rollers 407, and stop the conveyance of the sheet in the direction indicated by the arrow F (S160).

The sheet is the first sheet and therefore, the CPU 111 actuates the clamp solenoid 434-1 shown in FIG. 4 to thereby open the clamp claw 412-1 of the clamp mechanism 413-1 disposed at the sheet discharging position 416*d* (see FIG. 9) as shown in FIGS. 4, 6 and 7 and standing by at the home position 413*a*-1, as shown in FIG. 10 (S170). Then, the CPU 111 reverses the rotation of the conveying motor 431 to thereby rotate the offset rollers 407 in the direction indicated by the arrow G opposite to the sheet discharging direction, as shown in FIG. 10 (S180), and reversely conveys the sheet in the direction indicated by the arrow K which is the upstream side, and abuts the upstream edge (trailing edge) of the sheet against the trailing edge stopper 411 to thereby effect the alignment of the trailing edge (upstream edge) of the sheet (S190), and stops the rotation of the offset rollers 407 (S200).

The CPU 111 judges by the information of the sheet discharged from the copying machine whether the sheet is a sheet on which a binding process is to be executed (S210), and if the sheet is a sheet on which the binding process is to be executed, the CPU 111 opens the gripper claw 412-2 of another clamp mechanism 413-2. Depending on the size of the sheet, the gripper claw 412-2 may be opened together with a gripper claw 412-1 when the latter is opened. Then, the CPU 111 moves the offset rollers 407 by the offset motor 432 to thereby move the sheet toward the side edge aligning reference plate 416. As shown in FIG. 11, the sheet being in contact with the offset rollers 407 is also moved toward the side edge aligning reference plate 416 by the frictional force of the offset rollers 407 (S220). Also, when the sheet is the second or subsequent sheet P2, as described with reference to FIG. 15, the CPU 111 moves the offset rollers 407 in the direction crossing the sheet discharging direction to thereby abut the succeeding sheet P2 against the side edge aligning reference plate 416 and align the side edge P2*a* thereof (S570; S670).

Thereafter, in order to correct the shift of the alignment in the sheet discharging direction effected at S180, by offset movement, as shown in FIG. 11, the offset rollers 407 are rotated in a direction opposite to the sheet discharging direction to thereby perform the operation of aligning the upstream edge (trailing edge) of the sheet (S240). At this time, the sheet is abutted against the trailing edge stopper 411 so that some flexure may occur to the sheet, thereby enhancing the aligning property of the sheet. Thereafter, this flexure is eliminated by the elasticity of the sheet itself when the offset rollers 407 are lifted and separated from the sheet, and the sheet becomes flat.

Thereafter, as shown in FIG. 12, the offset rollers 407 are lifted by the driving of the pickup solenoid 433 (S250), whereafter the driving of the clamp solenoids 434-1 and 434-2 is released and the clamp claws 412-1 and 412-2 are closed to thereby hold down the aligned sheet (S260). Thus, it never happens that the sheet now discharged is carried away in the sheet conveying direction by a sheet discharged next. The offset rollers 407 in their lifted state are moved to a predetermined standby position by the offset motor 432 through the rack 441 and the pinion 439 (S270). This standby position is the standby position described with reference to FIGS. 13A to 13D and 14A to 14C. That is, as described with reference to FIG. 15, the CPU 111 sets the standby position of the offset rollers 407 to the home position 416*d* (S550) or L5 (S650), depending on whether the sheet width W is greater or smaller than the distance L3 between the offset rollers 407 and the side edge aligning reference plate 416.

Thereafter, the CPU 111 checks up whether the sheet stacked on the post-processing tray 410 is a sheet corresponding to the last page of the document to be copied (S280), and when it judges on the basis of information sent from the copying machine that it is not the sheet corresponding to the last page, return is made to S100, where the CPU receives a sheet discharging signal sent next from the copying machine, and repeats the aforedescribed flow until a sheet corresponding to the last page is stacked on the post-processing tray 410. Thereby, the CPU 111 of the sheet processing apparatus 400 grasps the size of a sheet and aligns the sheet with an offset position suited for the binding process of the sheet each time a sheet is discharged from the copying machine 500.

On the other hand, if at S280, it is judged that the sheet is a sheet corresponding to the last page, it means that a sheet bundle corresponding to the document to be copied is formed on the post-processing tray 410 and therefore, whether a stapling process is selected is checked up (S300), and if it is selected, the staple unit 420 is driven to thereby execute the stapling process (S310). After the stapling process has been completed, or even when the stapling process is not selected, the clamp claws 412-1 and 412-2 of the clamp mechanisms 413-1 and 413-2, respectively, are moved forward from the home position 413*a*-1 and 413*a*-2 of the clamp mechanisms 413-1 and 413-2 toward the stacking tray 421 by the sheet bundle discharging motors 430-1 and 430-2 through the racks 452-1, 452-2 and the pinions 451-1, 451-2 while gripping the sheet bundle, and are moved to the bundle discharging positions 413*b*-1 and 413*b*-2 of the clamp mechanisms 413-1 and 413-2, respectively (S320). Thereafter, the clamp solenoids 434-1 and 434-2 are driven, whereby the clamp claws 412-1 and 412-2 are opened, and the stacking tray 421 is lowered as will be described later (S330). The clamp mechanisms 413-1 and 413-2 are returned to the home positions **413*a*-1 and 413*a*-2, respectively (S340). The conveying motor 431 is stopped to thereby stop the rotation of the conveying rollers 405 and the offset rollers 407 (S350). Lastly, the offset rollers 407** are lowered (S360), thus terminating a series of processes.

Thus, the sheet processing apparatus 400 has bound a sheet bundle formed by the trailing edges (upstream edges) of the sheets being aligned by the trailing edge stopper 411, and the side edges of the sheets being aligned by the side edge aligning reference plate 416, by the stapler unit 420, and has discharged it onto the stacking tray 421.

In the above-described operation, the sheet bundle formed by the trailing edges and side edges of the sheets being aligned may be discharged without being subjected to the binding process.

Also, the number of the clamp mechanisms may be one. In this case, it is necessary to provide the clamp mechanism at a position whereat it can hold down the sheet irrespective of the size thereof.

In the sheet processing apparatus 400 according to the present embodiment, in the moving process of the stacking tray at the step S330, the sheet bundle stacked on the stacking tray 421 constitutes a portion of the post-processing tray 410 and therefore, when the sheet bundle is discharged from the post-processing tray 410, the stacking tray 421 is adapted to be lowered to a position in which the uppermost surface of the sheet bundle stacked on the stacking tray 421 is substantially flush with the post-processing tray 410, by the stacking tray lifting and lowering motor 135.

If at the step S210, the sheet binding process is not executed, the CPU 111 drives the pickup solenoid 433 to thereby lift the offset rollers 407 and separate it from the sheet (S290). Then, the CPU 111 releases the driving of the clamp solenoids 434-1 and 434-2, whereby the clamp claws 412-1 and 412-2 are closed to thereby hold down the aligned sheet (S292). Thus, it never happens that the sheet now discharged is carried away in the sheet conveying direction by a sheet discharged next.

Thereafter, the CPU 111 checks up whether the sheet stacked on the post-processing tray 410 is a sheet corresponding to the last page of the document to be copied (S280), and if it judges on the basis of information sent from the copying machine that the sheet is not a sheet corresponding to the last page, return is made to S100, where the CPU 111 receives a sheet discharging signal sent next from the copying machine, and repeats the aforedescribed flow until the sheet corresponding to the last page is stacked on the post-processing tray 410.

On the other hand, if at S280, it is judged that the sheet is the sheet corresponding to the last page, a sheet bundle corresponding to the document to be copied is formed on the post-processing tray 410. The CPU 111, if it judges at a step S300 that the stapling process is not executed, advances to a step S320, where it executes the processes of S320 to S360, thus terminating the sheet processing. Thus, the sheet bundle not subjected to the binding process has its trailing edge (upstream edge) aligned, and is discharged onto the stacking tray 421.

The sheet or the sheet bundle need not always be discharged onto the stacking tray 421.

Figure 3B:
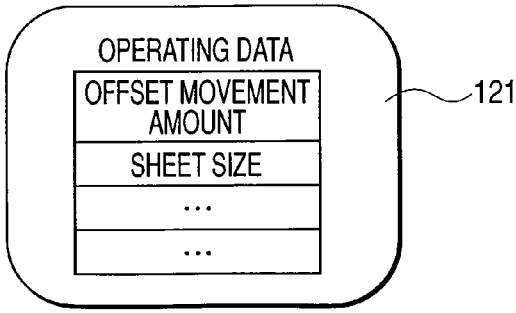
FIG. 3B shows the contents of operating data stored in the RAM 120 of FIG. 3A.
Figures 8, 8A:
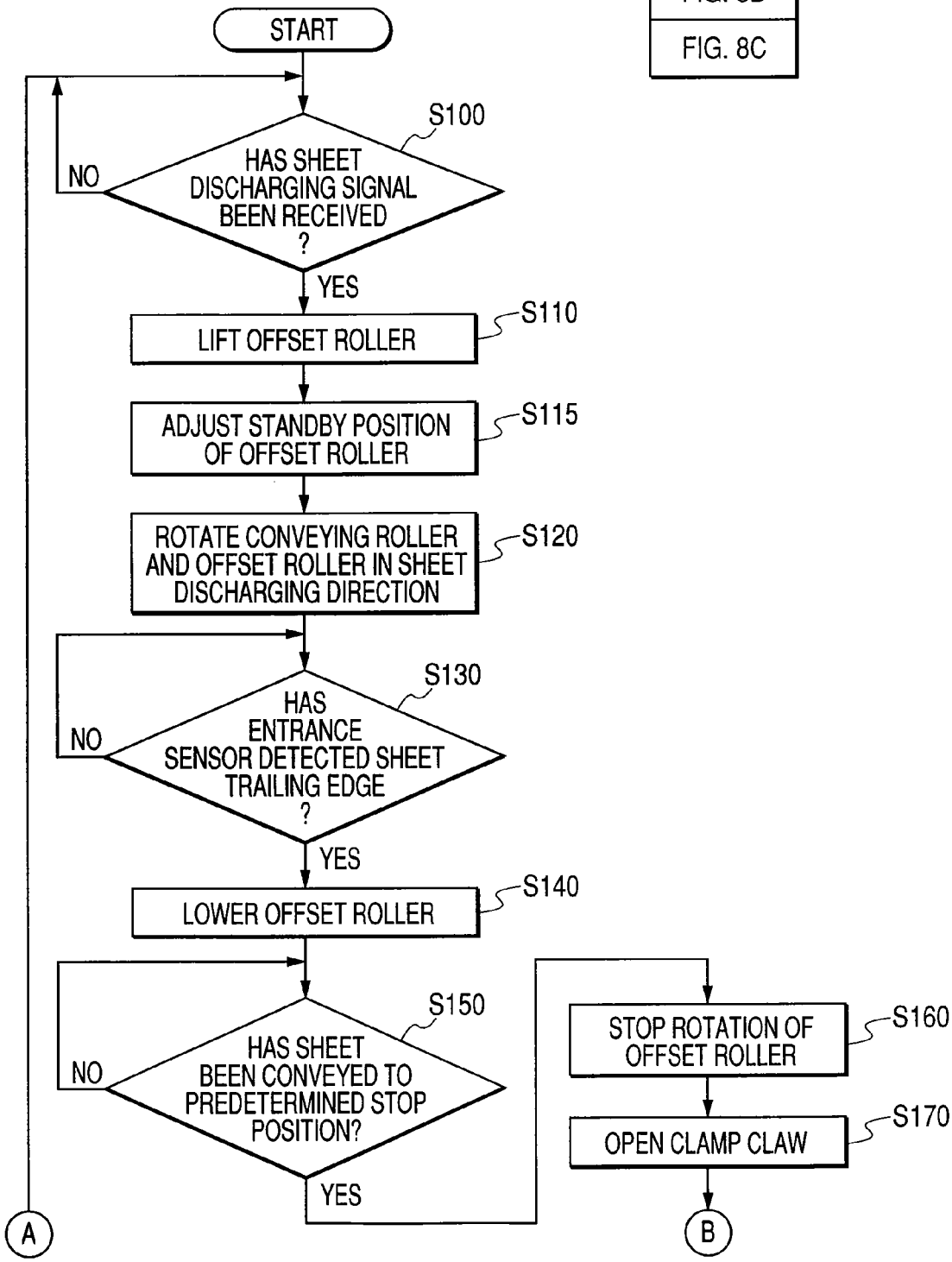
FIG. 8 which is composed of FIGS. 8A, 8B and 8C are flow charts for illustrating the operation of the sheet processing apparatus according to the embodiment of the present invention.
Figure 8B:
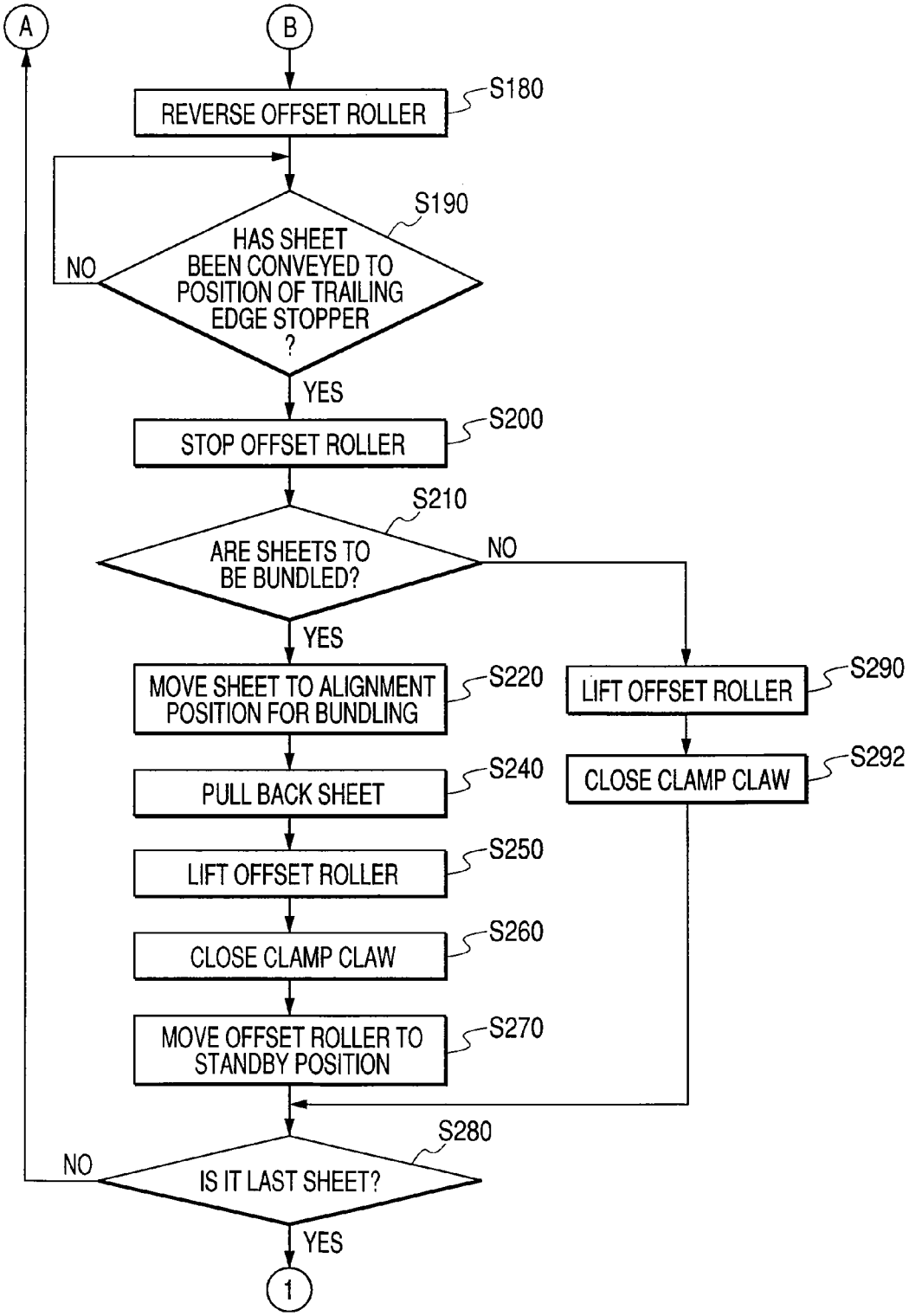
Figure 8C:
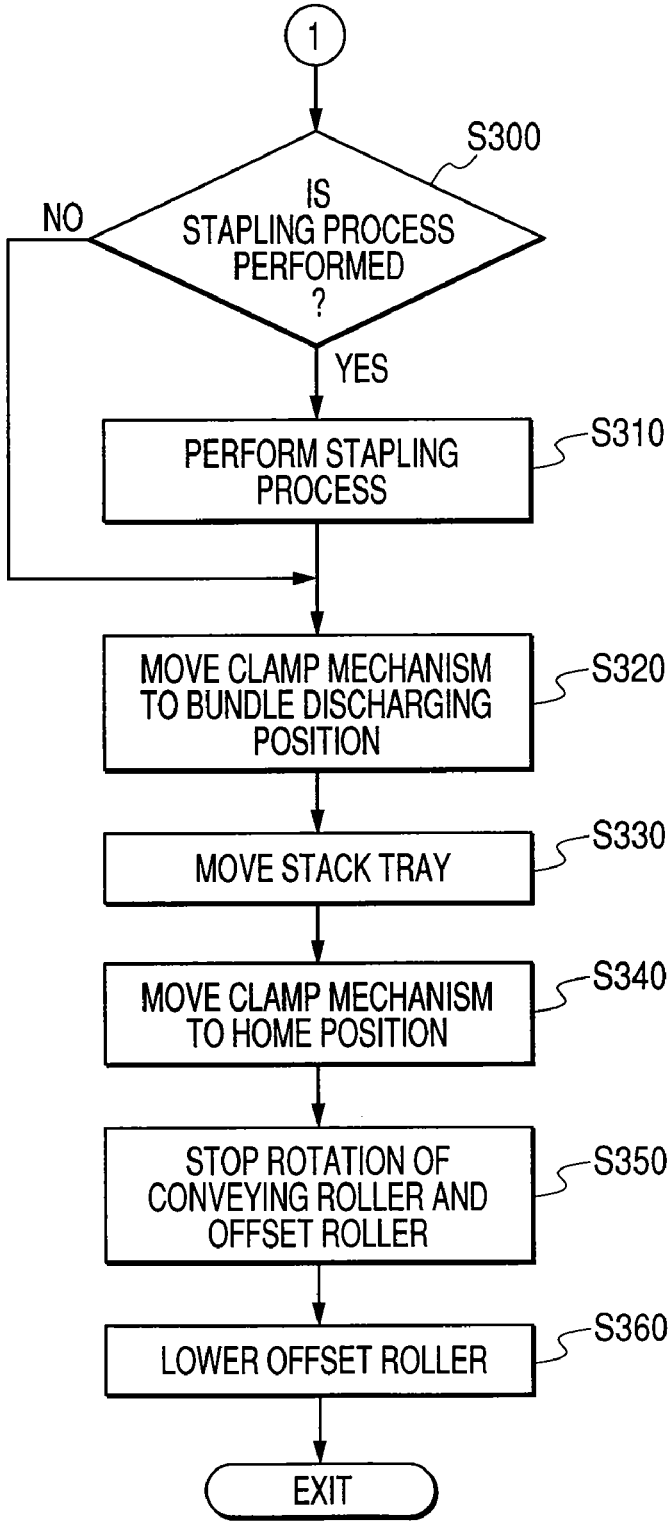

While in the sheet processing apparatus 400 according to the present embodiment, a program corresponding to the control procedure described in the flow chart shown in FIGS. 8A, 8B and 8C are stored in the ROM 110 shown in FIGS. 3A and 3B, and the CPU 111 effects the control of each portion while reading out the program, processing on the control program may be designed to be effected by hardware to thereby obtain a similar effect.

In the sheet processing apparatus according to the present embodiment, the cross-directionally moving device is adapted to move the next sheet from a position between the other side edge of a sheet received by the cross-side restricting member and the cross-side restricting member to the cross-side restricting member and therefore, it never happens that the sheet rides onto the other side edge of the preceding sheet through a succeeding sheet. Therefore, the sheet processing apparatus can reliably abut one side edge of the succeeding sheet against the cross-side restricting member almost without sliding relative to the succeeding sheet, and can enhance the aligning property of the side edge of the sheet.

Further, it never happens that the cross-directionally moving member rides onto the other side edge of the preceding sheet through the succeeding sheet and therefore, the alignment of the preceding sheet is neither disturbed, and the aligning property of the side edge of the sheet can be enhanced.

Another embodiment of the present invention will now be described with reference to FIG. 16.

The CPU 111 in this embodiment judges the width size of sheets stacked on the post-processing tray 410, and calculates the amount of movement to e.g. the side edge aligning reference plate 416 (see FIG. 9) which is the cross-side restricting member. The offset rollers 407 are brought into contact with the sheet, whereafter the offset rollers 407 abut the sheet against the side edge aligning reference plate 416 by the utilization of the frictional force thereof with the sheet and executes a side edge aligning process. At that time, as shown in FIG. 16, before the sheet abuts against the side edge aligning reference plate 416, the offset rollers are changed over to a speed different from the speed during the movement thereof (deceleration in FIG. 16). After the speed of the offset rollers 407 has been changed over, the sheet is abutted against the side edge aligning reference plate 416, and the offset rollers, 407 slide on the sheet, thus terminating the side edge aligning process. The offset rollers 407 are decelerated from a certain position and effects the abutting and alignment and therefore, in addition to sufficiently securing productivity, they make the mitigation of damage to the sheet after the aligning process possible. The speed and the movement distance are controlled by the CPU 111.

The side edge aligning reference plate 416 is provided along and in parallelism to the sheet discharging direction. The side edges of the sheet are edges along the sheet discharging direction.

Figure 16:
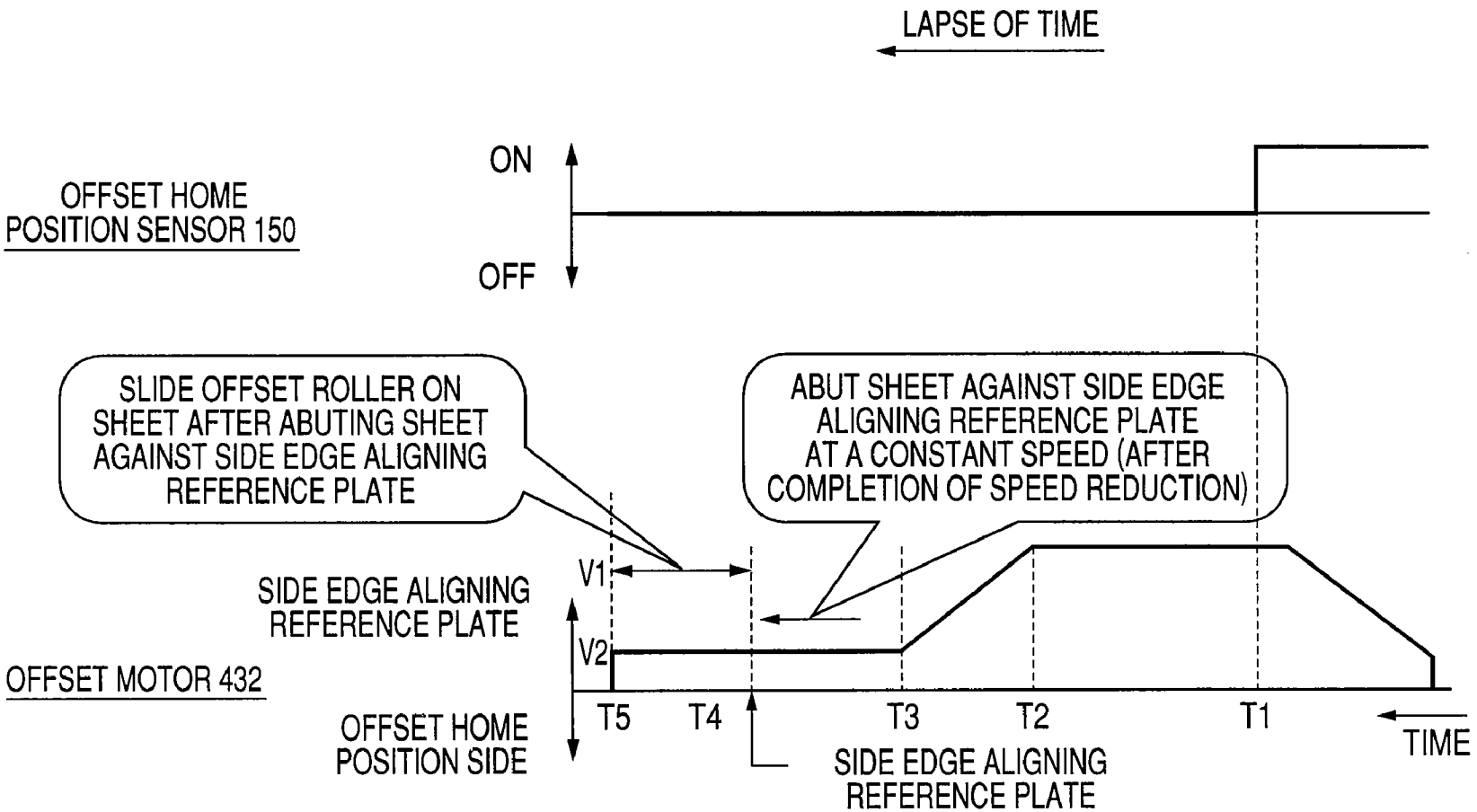
FIG. 16 shows the operation during the movement of offset rollers according to another embodiment of the present invention in the width direction of the sheet.

FIG. 16 shows the relation between the movement speed of the offset rollers 407 and time. In FIG. 16, the offset motor 432 is started and the offset rollers 407 start their movement, and at a point of time (time T1) whereat the offset home position sensor 150 has become OFF, the offset rollers 407 are moved toward the side edge aligning reference plate 416 at a movement speed V1 to thereby move the sheet. Then, the offset rollers 407 are decelerated from the movement speed V1 to a movement speed V2 (<V1) by the offset motor 432 between a time T2 when it has come close to the side edge aligning reference plate 416 and a time T3, and cause the side edge PS of the sheet P to abut against the side edge aligning reference plate 416 between the time T3 and a time T4 (see FIG. 11), thus effecting side edge alignment. Thereafter, the offset rollers 407 slide on the sheet received by the side edge aligning reference plate 416 at the speed V2 till a time T5, and are stopped. The offset rollers 407 form flexure in the sheet while sliding on the sheet. Therefore, the sheet has its side edge reliably urged against the side edge aligning reference plate 416, and is enhanced in side edge alignment accuracy.

Lastly, the offset rollers 407 are returned to and stopped at an offset home position whereat the offset home position sensor 150 becomes ON, by the reverse rotation of the offset motor 432. The offset rollers 407, when returned to the offset home position, are separated from the sheet and returned and therefore, do not disturb the side edge alignment of the sheet.

As described above, the sheet processing apparatus 400 is designed such that the offset rollers 407 move the sheet at a decelerated speed to thereby cause the sheet to abut against the side edge aligning reference plate 416 and therefore, can mitigate the disturbance of alignment due to the rebound or the like of the sheet by the reaction after the sheet has been abutted against the side edge aligning reference plate 416 to thereby execute a highly accurate side edge aligning process, and can decrease the misalignment of the sheet during the side edge alignment.

In the movement of the offset rollers 407, the movement distance corresponding to the time between the time T1 before the deceleration and the time T2 is set longer than the decelerated movement distance corresponding to the time between the time T2 and the time T3. Therefore, the sheet processing apparatus 400 can effect side edge alignment almost without lengthening the side edge aligning process time even if the sheet is decelerated and is abutted against the cross-side restricting plate 416, and can enhance the accuracy of sheet side edge alignment almost without reducing the sheet processing efficiency.

As described above, the CPU 111 of the sheet processing apparatus 400 is adapted to grasp the sheet size of the sheet conveyed from the apparatus main body 500A of the copying machine 500, and control the offset motor 432 for moving the offset rollers 407 in the width direction by an amount of movement according to the sheet size.

Figures 17, 17A:
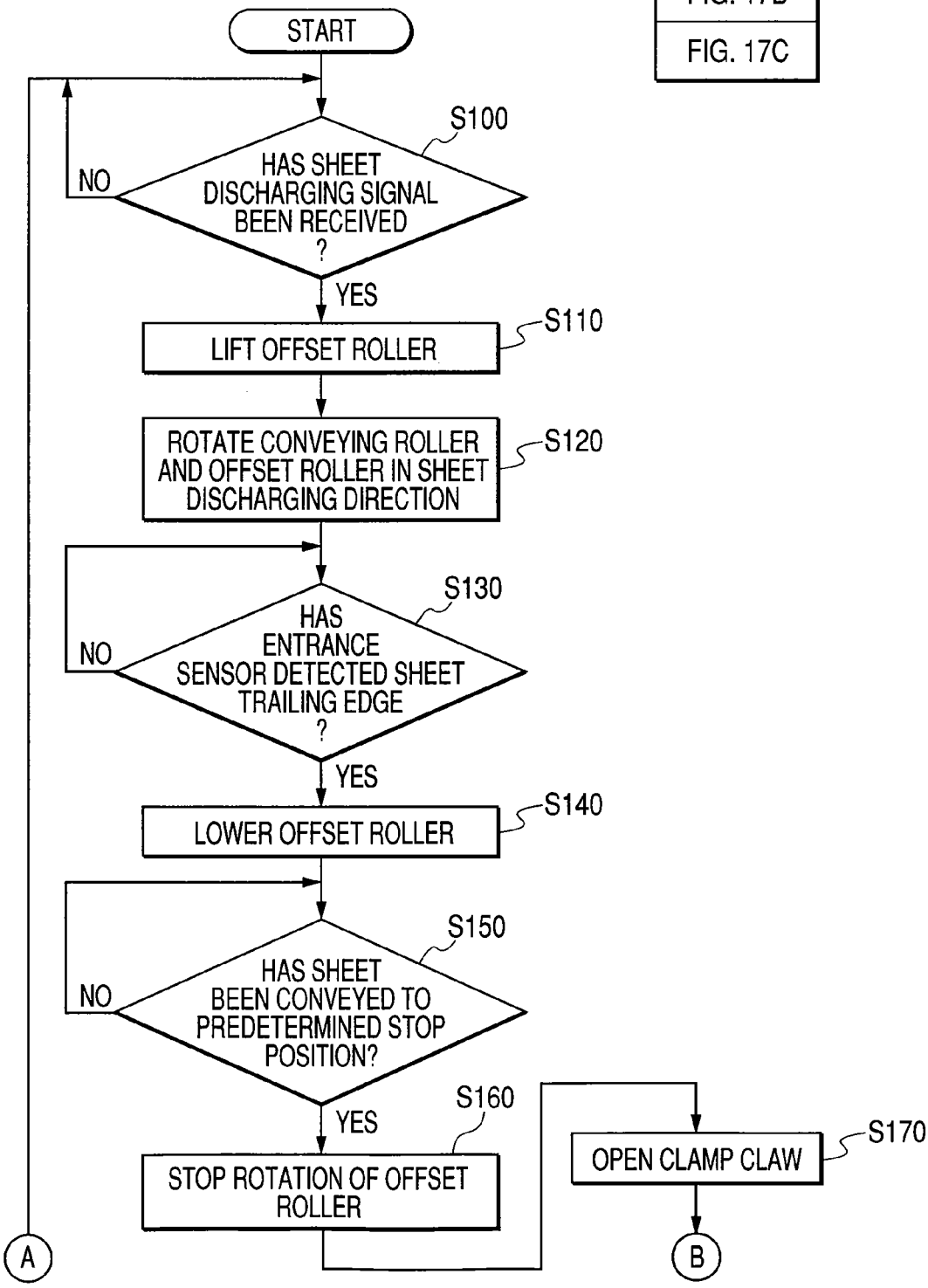
FIG. 17 which is composed of FIGS. 17A, 17B and 17C are flow charts showing the operation of a sheet processing apparatus according to the embodiment shown in FIG. 16.
Figure 17B:
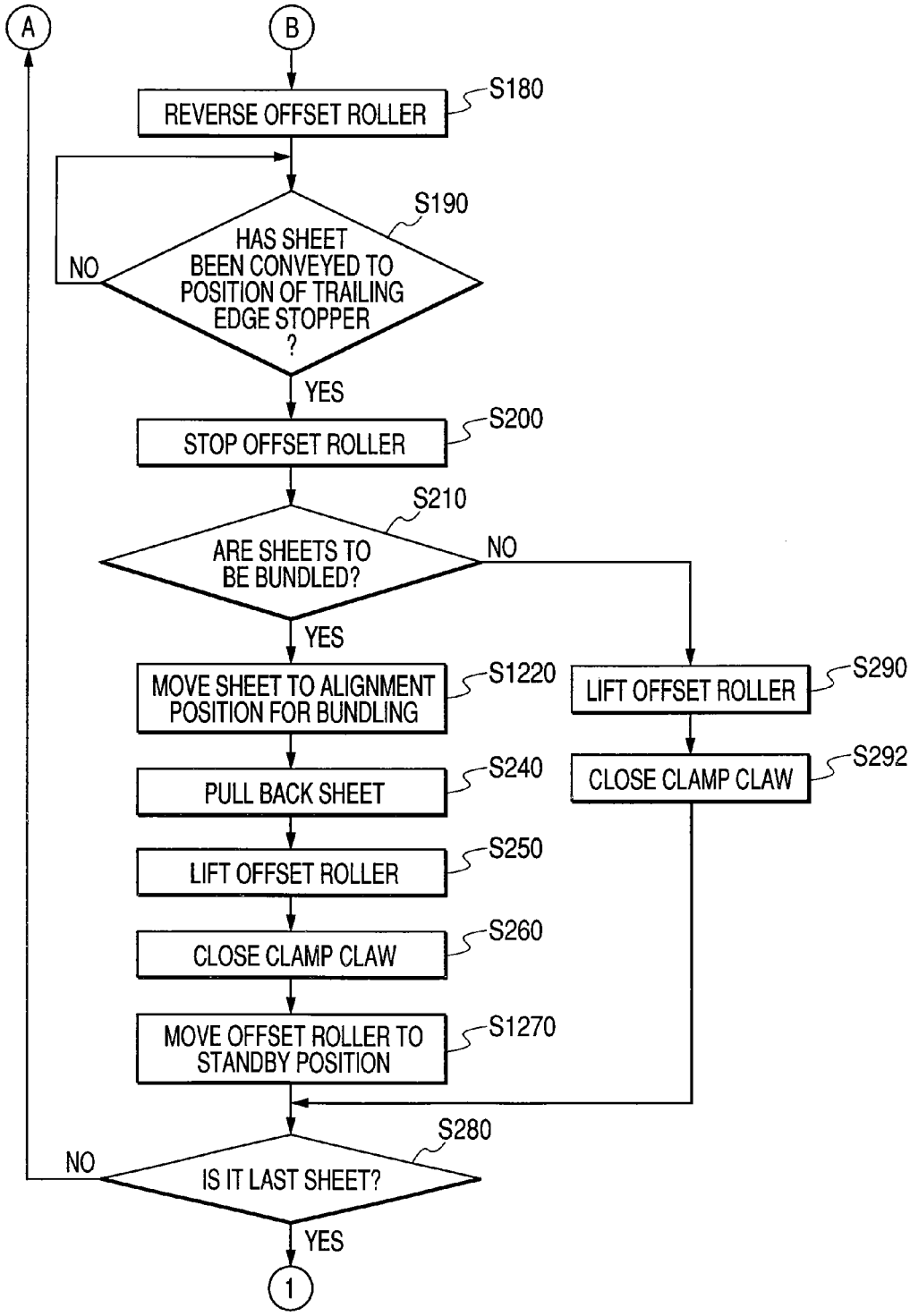
Figure 17C:
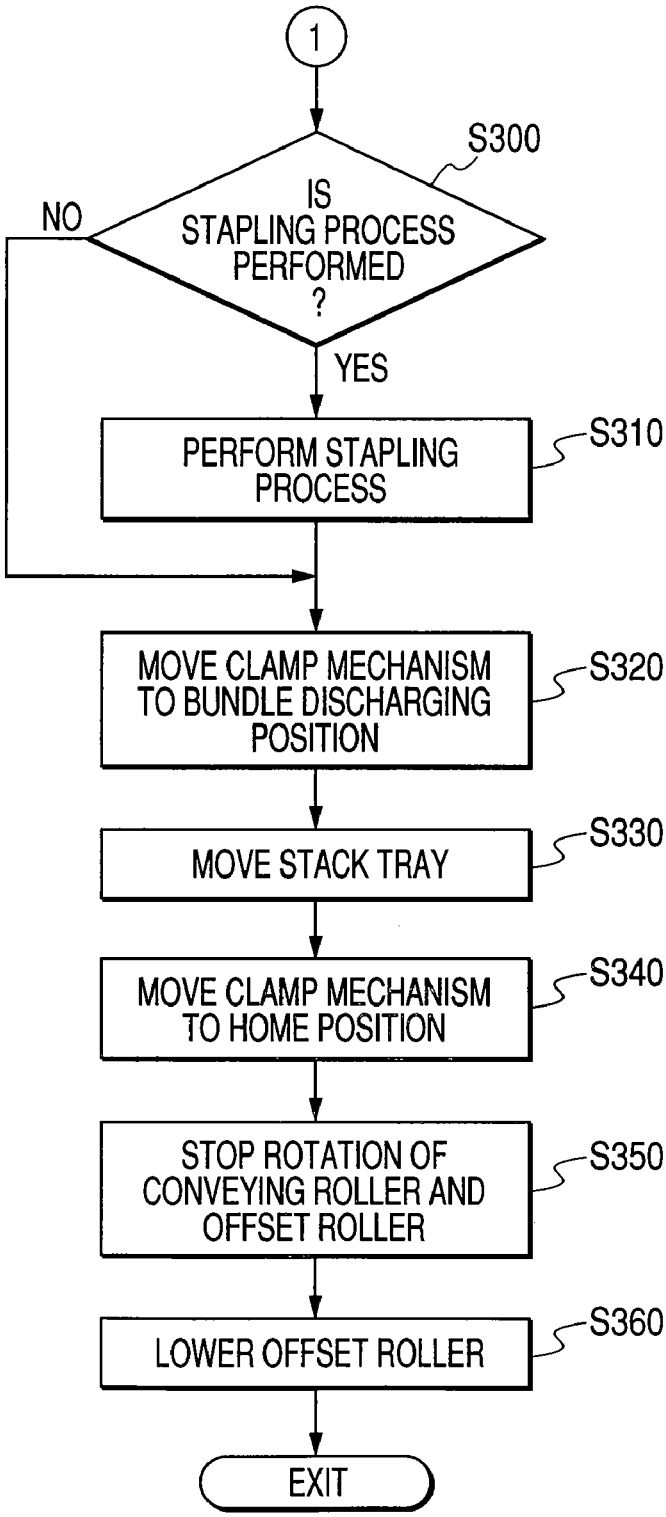

FIGS. 17A, 17B and 17C are flow charts showing the operation of the sheet processing apparatus according to the embodiment shown in FIG. 16. The differences of the flow chart shown in FIGS. 17A, 17B and 17C from the flow chart shown in FIGS. 8A, 8B and 8C reside in steps S115, S220, S270, S1220 and S1270. The other steps in FIGS. 17A, 17B and 17C are similar to the steps in FIGS. 8A, 8B and 8C, and are given similar reference characters and need not be described.

In FIGS. 17A, 17B and 17C, there is not shown the adjustment (S115) of the standby position of the offset rollers 407 after the CPU 111 has received a sheet discharging signal (S100) and has lifted the offset rollers 407 (S110). However, again in the embodiment shown in FIG. 16, the adjustment (S115) of the standby position of the offset rollers 407 may be effected.

At the step S1220 in FIGS. 17A, 17B and 17C, the CPU 111 moves the offset rollers 407 by the offset motor 432 to thereby move the sheet toward the side edge aligning reference plate 416. The sheet being in contact with the offset rollers 407 is also moved toward the side edge aligning reference plate 416 by the frictional force of the offset rollers 407. At this time, as shown in FIG. 16, the CPU 111 causes the sheet decelerated in the course of movement of the offset rollers 407, and having completed the deceleration on this side of the side edge aligning reference plate 416 to be abutted against the side edge aligning reference plate 416 at a low speed. The sheet is received by the side edge aligning reference plate 416. Thereafter, the offset rollers 407 slide on the sheet, thus completing the side edge aligning process.

At the step S1270 in FIGS. 17A, 17B and 17C, the offset rollers 407 in their lifted state are moved to the standby position by the offset motor 432 through the rack 441 and the pinion 439. In the present embodiment, the standby position is the offset home position 416*d*. However, again in the present embodiment, as in the aforedescribed embodiment, the standby position may be changed in accordance with the sheet width.

In the sheet processing apparatus according to the present embodiment, the cross-directionally moving device is adapted to decelerate and move the sheet to thereby cause the sheet to abut against the cross-side restricting member and therefore, the disturbance of alignment due to the rebound or the like of the sheet by the reaction after the sheet has been abutted against the cross-side restricting member can be mitigated and a highly accurate side edge aligning process can be executed, and the misalignment of the sheet during the side edge alignment can be reduced.

In the sheet processing apparatus according to the present embodiment, the movement distance before deceleration is set longer than the decelerated movement distance and therefore, even if the sheet is decelerated and is abutted against the cross-side restricting member, side edge alignment can be done almost without the side edge aligning process time being lengthened, and the accuracy of the sheet side edge alignment can be enhanced almost without the sheet processing efficiency being reduced.

In the sheet processing apparatus according to the present embodiment, the cross-directionally moving device is adapted to move the sheet by a predetermined amount still after the sheet has been caused to abut against the cross-side restricting member and therefore, flexure occurs to the side edge portion of the sheet and the alignment accuracy of the side edge of the sheet can be enhanced.

An image forming apparatus according to the present embodiment is provided with the above-described sheet processing apparatus which can align the side edge of the sheet easily and with good accuracy and therefore, can enhance image forming efficiency.

While the invention has been described with reference to the structure disclosed herein, it is not confined to the details set forth and this application is intended to cover such modifications or changes as may come within the purpose of the improvements or the scope of the following claims.

What is claimed is:

1. A sheet processing apparatus comprising:

a sheet conveying portion configured to convey a sheet in a direction crossing a sheet discharging direction and to move in an up-and-down direction to be separable from and come into contact with the sheet;

a cross-directionally moving portion configured to move the sheet conveying portion in the direction crossing the sheet discharging direction;

an up-and-down directionally moving portion configured to move the sheet conveying portion in the up-and-down direction;

a cross-side restricting member configured to receive one side edge of the sheet moved by the sheet conveying portion in the direction crossing the sheet discharging direction to align the one side edge, said one side edge of the sheet being along the sheet discharging direction; and a controller which controls said cross-directionally moving portion and said up-and-down directionally moving portion, wherein said controller is configured to control:

(i) movement of said sheet conveying portion by said up-and-down directionally moving portion from a separated position, where said sheet conveying portion is separated from the sheet and is distant from said cross-side restricting member, to a press-contact position, where said sheet conveying portion press-contacts an upper surface of the sheet, (ii) movement of said sheet conveying portion by said cross-directionally moving portion in the direction of said cross-side restricting member from the press-contact position while press-contacting the upper surface of the sheet by said sheet conveying portion, (iii) separation of said sheet conveying portion from the sheet by said up-and-down directionally moving portion, and (iv) movement of said sheet conveying portion, separated from the sheet, by said cross-directionally moving portion in a direction of the separated position and which intersects with sheet discharging direction, and wherein the press-contact position is a position between the cross-side restricting member and the other side edge of the sheet that is not received by the cross-side restricting member.

2. A sheet processing apparatus according to claim 1, further comprising:

a sheet stacking portion on which the sheet is stacked; and a sheet discharging member, which discharges the sheet onto said sheet stacking portion, wherein said sheet discharging member discharges the next sheet to a position overlapping the other side edge of the sheet that is not received by said cross-side restricting member.

3. An image forming apparatus comprising:

an image forming portion, which forms an image on a sheet; and a sheet processing apparatus as recited in claim 1 or 2, wherein said sheet processing apparatus aligns one side edge of the sheet on which the image has been formed by said image forming portion.

4. An image forming apparatus comprising:

an image forming portion, which forms an image on a sheet;

a sheet stacking portion on which the sheet is stacked;

a sheet conveying portion configured to convey the sheet in a direction crossing a sheet discharging direction and to move in an up-and-down direction to be separable from and come into contact with the sheet;

a cross-directionally moving portion configured to move the sheet conveying portion in the direction crossing the sheet discharging direction;

an up-and-down directionally moving portion configured to move the sheet conveying portion in the up-and-down direction;

a cross-side restricting member configured to receive one side edge of the sheet moved by the sheet conveying portion in the direction crossing the sheet discharging direction to align the one side edge, said one side edge of the sheet being along the sheet discharging direction; and a controller which controls said cross-directionally moving portion and said up-and-down directionally moving portion, wherein said controller is configured to control:

(i) movement of said sheet conveying portion by said up-and-down directionally moving portion from a separated position, where said sheet conveying portion is separated from the sheet and is distant from said cross-side restricting member, to a press-contact position, where said sheet conveying portion press-contacts an upper surface of the sheet, (ii) movement of said sheet conveying portion by said cross-directionally moving portion in the direction of said cross-side restricting member from the press-contact position while press-contacting the upper surface of the sheet by said sheet conveying portion, (iii) separation of said sheet conveying portion from the sheet by said up-and-down directionally moving portion, and (iv) movement of said sheet conveying portion, separated from the sheet, by said cross-directionally moving portion in a direction of the separated position and which intersects with sheet discharging direction, and wherein the press-contact position is a position between the cross-side restricting member and the other side edge of the sheet that is not received by the cross-side restricting member.

* * * * *